US011585500B2

(12) United States Patent
Spicer et al.

(10) Patent No.: US 11,585,500 B2
(45) Date of Patent: Feb. 21, 2023

(54) LIGHTING FIXTURE HAVING AN ADJUSTABLE OPTIC SYSTEM

(71) Applicant: Intense Lighting, LLC., Anaheim, CA (US)

(72) Inventors: Jonathan Spicer, Lakewood, CA (US); Warren Woody, Lake Forest, CA (US); Kevin Brian Eidsvold, Yorba Linda, CA (US)

(73) Assignee: Intense Lighting, LLC.

( * ) Notice: Subject to any disclaimer, the term of this patent is extended or adjusted under 35 U.S.C. 154(b) by 0 days.

(21) Appl. No.: 17/523,123

(22) Filed: Nov. 10, 2021

(65) Prior Publication Data

US 2022/0065412 A1 Mar. 3, 2022

Related U.S. Application Data

(63) Continuation of application No. 16/862,922, filed on Apr. 30, 2020, now Pat. No. 11,215,332.

(60) Provisional application No. 62/841,974, filed on May 2, 2019.

(51) Int. Cl.

| | |
|---|---|
| ***F21S 8/02*** | (2006.01) |
| ***F21V 21/14*** | (2006.01) |
| ***F21V 21/04*** | (2006.01) |
| ***F21V 29/70*** | (2015.01) |
| ***F21K 9/20*** | (2016.01) |
| ***F21Y 115/10*** | (2016.01) |

(52) U.S. Cl.

CPC ..... *F21S 8/026* (2013.01); *F21K 9/20* (2016.08); *F21V 21/048* (2013.01); *F21V 21/14* (2013.01); *F21V 29/70* (2015.01); *F21Y 2115/10* (2016.08)

(58) Field of Classification Search

CPC ..... F21S 8/026; F21K 9/20; F21V 21/048; F21V 21/14; F21V 29/70; F21V 21/04; F21V 29/773; F21V 21/30; F21Y 2115/10

See application file for complete search history.

(56) References Cited

U.S. PATENT DOCUMENTS

| | | | |
|---|---|---|---|
| 3,518,420 | A | 6/1970 | Kripp |
| 4,048,491 | A | 9/1977 | Wessman |
| 5,077,650 | A | 12/1991 | Cestari |
| 5,907,648 | A | 5/1999 | Miller et al. |
| 7,186,008 | B2 | 3/2007 | Patti |

(Continued)

FOREIGN PATENT DOCUMENTS

| | | | |
|---|---|---|---|
| WO | 9300552 | A1 | 1/1993 |

*Primary Examiner* — Tsion Tumebo

(74) *Attorney, Agent, or Firm* — KDB Firm PLLC

(57) ABSTRACT

A lighting assembly is disclosed. The lighting assembly including a number of separate and distinct features to improve useable, installation ease, etc. In one embodiment, the lighting assembly includes a heat sink, a light source, and an adjustment module portion coupled to the heat sink. The adjustment module portion includes a pivot core having a primary optic for directing light from the light source through the adjustment module. The adjustment module portion also includes a collar spring mount having first and second brackets for slidably engaging the pivot core along a plurality of guide slots such that the pivot core moves horizontally with respect to the collar spring mount as the pivot core is tilted with respect to the collar spring mount. The plurality of guide slots may include first, second and third guide slots, each of which has a different shape.

19 Claims, 26 Drawing Sheets

(56) References Cited

U.S. PATENT DOCUMENTS

| | | | | |
|---|---|---|---|---|
| 7,234,674 | B2 | 6/2007 | Rippel et al. | |
| 7,559,677 | B1 | 7/2009 | Dupre | |
| 7,896,529 | B2 | 3/2011 | Wronski et al. | |
| 7,967,480 | B2 | 6/2011 | Pickard et al. | |
| 3,182,120 | A1 | 5/2012 | Wronski et al. | |
| 8,215,805 | B2 * | 7/2012 | Cogliano | F21V 21/04 362/365 |
| 8,636,387 | B1 | 1/2014 | Wronski et al. | |
| 9,062,866 | B1 * | 6/2015 | Christ | F21V 29/70 |
| 10,274,148 | B2 | 4/2019 | Eidsvold et al. | |
| 10,344,958 | B2 | 7/2019 | Mathews et al. | |
| 10,948,167 | B2 | 3/2021 | Wilcox | |
| 2003/0007354 | A1 | 1/2003 | Schubert et al. | |
| 2008/0112171 | A1 | 5/2008 | Patti et al. | |
| 2008/0224008 | A1 | 9/2008 | Dal Ponte et al. | |
| 2009/0080189 | A1 | 3/2009 | Wegner | |
| 2009/0284958 | A1 | 11/2009 | Pickard et al. | |
| 2010/0149822 | A1 * | 6/2010 | Cogliano | F21V 21/30 362/365 |
| 2011/0193498 | A1 | 8/2011 | O'Boyle et al. | |
| 2013/0170232 | A1 | 7/2013 | Park et al. | |
| 2013/0215623 | A1 | 8/2013 | Goodman et al. | |
| 2015/0078012 | A1 | 3/2015 | Delano | |
| 2015/0241038 | A1 | 8/2015 | Fryzek | |
| 2015/0241039 | A1 * | 8/2015 | Fryzek | F21S 8/026 362/419 |
| 2015/0252988 | A1 | 9/2015 | Doust | |
| 2016/0169490 | A1 | 6/2016 | Kijima et al. | |
| 2017/0234517 | A1 | 8/2017 | Highbridge | |
| 2019/0063724 | A1 | 2/2019 | Vice, Jr. et al. | |
| 2019/0271456 | A1 * | 9/2019 | Hierzer | F21V 7/04 |

* cited by examiner

LIGHTING FIXTURE HAVING AN ADJUSTABLE OPTIC SYSTEM

CROSS-REFERENCE TO RELATED APPLICATIONS

The present application is a continuation application of pending U.S. patent application Ser. No. 16/862,922, filed Apr. 30, 2020, entitled "Lighting Fixture Having an Adjustable Optic System," which is a non-provisional of, and claims the benefit of the filing date of, and priority to U.S. Provisional Patent Application Ser. No. 62/841,974, filed May 2, 2019, entitled "Lighting Fixture Having an Adjustable Optic System," the entirety of each application is incorporated by reference herein.

FIELD OF THE DISCLOSURE

The disclosure relates generally to a light fixture, and more particularly to a light fixture having a number of separate and distinct improvements including an angularly adjustable optic system.

BACKGROUND OF THE DISCLOSURE

Recessed lighting fixtures are often installed in ceilings to direct light down into a space. Such lighting fixtures can have the effect of making the associated space appear larger than it actually is. For example, recessed ceiling lighting fixtures can give the sense of a higher ceiling.

In ceiling applications, the fixtures and lighting elements are typically installed above the ceiling, and a reflector or other light-directing structure can extend through an opening in the ceiling to direct light down into the space. To provide a desired finish it is desirable that the reflector or other light-directing structure be installed flush with the ceiling. For new construction applications this may be relatively easily accomplished since ceiling thicknesses in new construction are standardized. For retrofit applications in older buildings or houses, however, ceiling thicknesses can vary widely.

Adjustable lighting fixtures have also been developed to allow the direction of a light cone to be selectively directed to a desired location within the space. Problems exist with such lighting fixtures however because tilting the light source often causes a portion of the light cone to be blocked by the opening in the ceiling, thus reducing the total amount of light directed to the space. In addition, tilting the light source also changes the distance between the light source and the opening formed in the ceiling. These problems become worse at larger tilt angles.

Accordingly, there is a need to provide an adjustable lighting fixture that reduces or eliminates the degree to which the light cone is blocked by the opening in the ceiling, particularly at large tilt angles. Additionally, there is a need to provide such an adjustable lighting fixture having a relatively small footprint so the fixture and its associated components can be easily installed through existing openings in ceiling. There is further a need for a lighting fixture that can be easily incorporated into both new construction and remodeling applications.

SUMMARY OF THE DISCLOSURE

This Summary is provided to introduce a selection of concepts in a simplified form that are further described below in the Detailed Description. This Summary is not intended to necessarily identify key features or essential features of the claimed subject matter, nor is it intended as an aid in determining the scope of the claimed subject matter.

According to an exemplary embodiment of the present disclosure, an adjustable lighting assembly is disclosed. In one embodiment, the lighting assembly includes a heat sink; a light source coupled to the heat sink; an adjustment module portion coupled to the heat sink, the adjustment module portion including a pivot core having a primary optic mounted thereto, the primary optic for directing light from the light source through the adjustment module; the adjustment module portion further comprising a collar spring mount having first and second brackets for slidably engaging the pivot core along a plurality of guide slots such that the pivot core moves horizontally with respect to the collar spring mount as the pivot core is tilted with respect to the collar spring mount; and a collar flange assembly that is coupleable within an opening in a ceiling.

According to another embodiment of the present disclosure, an adjustment module for use with an adjustable lighting assembly is disclosed. In one embodiment, the adjustment module includes a pivot core having a primary optic mounted thereto, the primary optic for directing light from the light source through the adjustment module; a collar spring mount having first and second brackets for slidably engaging the pivot core along a plurality of guide slots such that the pivot core moves horizontally with respect to the collar spring mount as the pivot core is tilted with respect to the collar spring mount; and a collar flange assembly that is coupleable within an opening in a ceiling.

BRIEF DESCRIPTION OF THE DRAWINGS

By way of example, a specific embodiment of the disclosed device will now be described, with reference to the accompanying drawings, in which.

DETAILED DESCRIPTION

Figure 1:
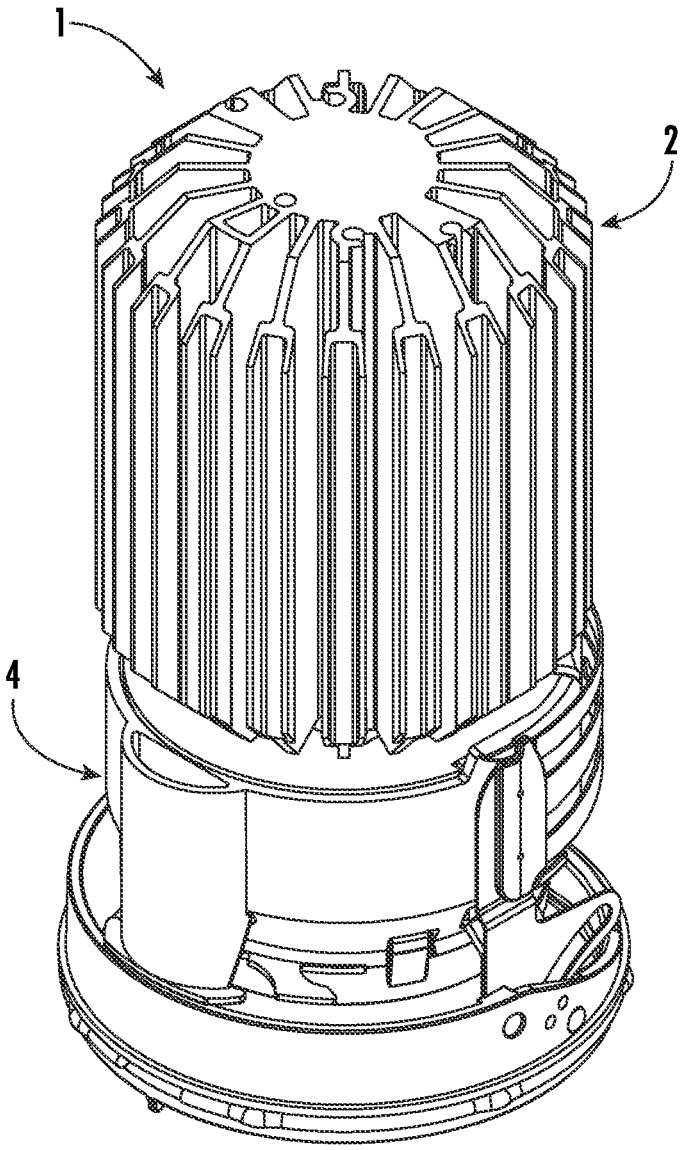
FIG. 1 is an isometric view of an example adjustable lighting assembly according to the disclosure.

The following disclosure is intended to provide exemplary embodiments of the disclosed system and method, and these exemplary embodiments should not be interpreted as limiting. One of ordinary skill in the art will understand that the steps and methods disclosed may easily be reordered and manipulated into many configurations, provided they are not mutually exclusive. As used herein, "a" and "an" may refer to a single or plurality of items and should not be interpreted as exclusively singular unless explicitly stated.

As will be disclosed herein, the adjustable lighting assembly includes a number of separate and independent features to improve the workability and/or to ease installation of the adjustable lighting assembly. For example, the disclosed adjustable lighting assembly employs adjustment features that, when the assembly is tilted to adjust a direction of the light cone, maintains the center of the light cone directed at the ceiling opening, thereby resulting in high efficiency light performance. The arrangement allows the adjustable lighting assembly to slide horizontally to maintain a center beam optic position at the ceiling opening for high efficiency light performance. This motion is guided via fasteners and/or pins that slide within a plurality of slots in a pair of guide brackets. Although the description will proceed in relation to a pair of guide brackets, it will be appreciated that the adjustable lighting assembly could include only a single guide bracket. In one embodiment, the slots each have unique geometry relative to one another and function together to triangulate a mounting position of the adjustable lighting assembly and to hold the entire adjustable lighting assembly at a precise angle. The slots are in the form of, or include, compound curves to provide desired assembly positions that will optimize light output. In addition, the compound curves of the slots seek to constrain or reduce the overall height of the assembly through its full range of its tilting motion. In one non-limiting example embodiment, a top slot is an "s"-shaped spline, a center slot is straight line for maintaining a horizontal transitional path, and a bottom slot is an arc that acts as sway bar keeping the optic centered at the ceiling opening.

In accordance with another feature, as the adjustable lighting assembly is tilted, to assume a desired lighting angle, a pivot core portion of the lighting fixture is adapted and configured to maintain its desired tilted position without the need for additional fastening elements to freeze the position of the module. For example, in one embodiment, as the adjustable lighting assembly is titled, to assume a desired lighting angle, a pivot core portion of the adjustable lighting assembly engages brackets made from spring steel that have a natural curve, and which undergo controlled deformation as they engage the core. This deformation causes a spring force to be applied against the core that holds the core in a desired tilted position without the need for additional fastening elements to freeze the position of the module. The curved guide brackets also allow the model geometry in to fit into and/or through a small pre-existing opening in the ceiling. The brackets also act as a counterbalance that supports the weight of the device's heatsink for easy adjustment. The brackets further act as sway bars that allow the device to slide smoothly along the guide brackets.

In accordance with another feature, the adjustable lighting assembly may also include a controlled axial rotation feature, which allows the adjustable lighting assembly to rotate about 360°. For example, in one embodiment, the controlled axial rotation feature includes a collar that is axially rotatable about 360° and is held in place by frictional detent surfaces.

In some embodiments the adjustable lighting assembly may also include a snap-in mount for engaging a primary optic. The optic mount can be constructed of plastic and can include an opening (e.g., a seam) that enables the mount to flex outward upon application of suitable force to allow the primary optic to be received therein. Thus, the optic mount can function as a living hinge that allows the primary optic to snap into features in the mount. The outside surfaces of the mount can be smooth, allowing the guide brackets to slide across the mount surface with reduced friction. Secondary snap features in the mount can also capture a secondary system optic. The mount can include additional features for receiving the tabs of an accessory holder to snap-engage the accessory holder to the mount. A front adjustment surface on the module allows for hand adjustment or tool adjustment of the module.

Figure 2B:
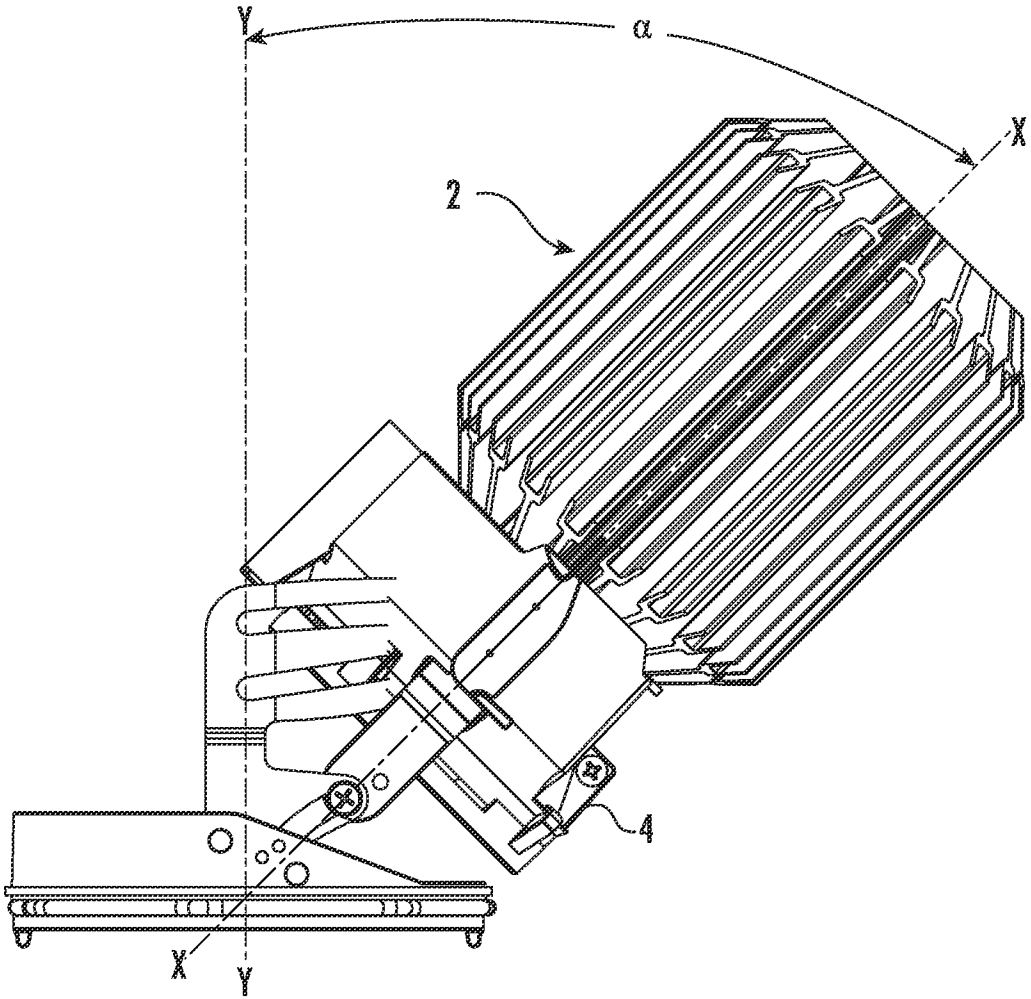
FIG. 2B is a side view of the example adjustable lighting assembly in a tilted position.
Figure 2A:
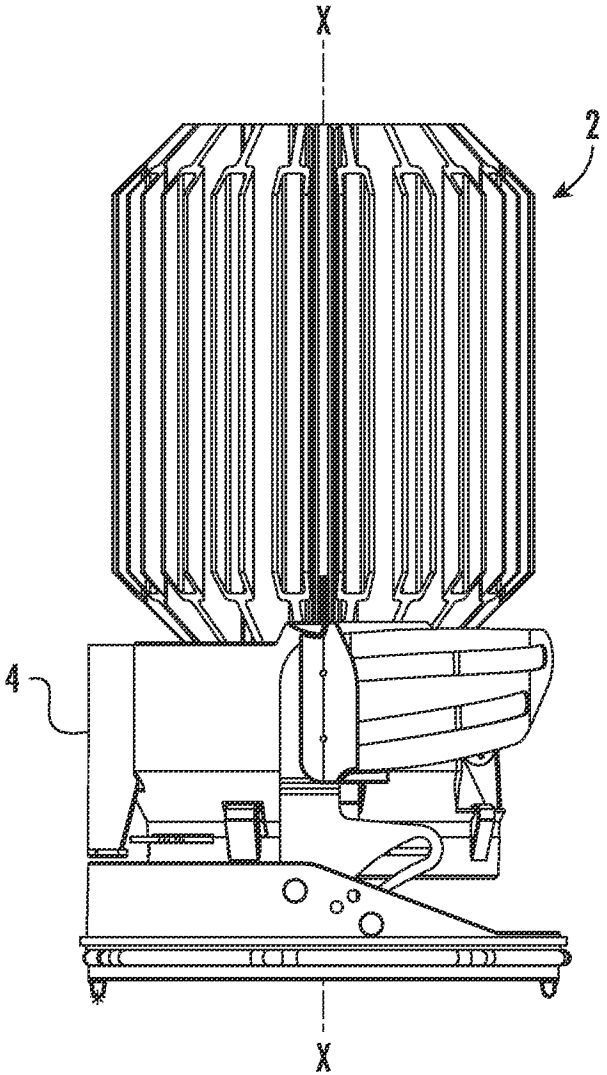
FIG. 2A is a side view of the example adjustable lighting assembly of FIG. 1 disposed in a vertical position.

Referring now to FIGS. 1-2B, an exemplary adjustable lighting assembly 1 includes a heat sink 2 coupled to an adjustment module portion 4. In general, the adjustment module portion 4 enables the heat sink 2 (and an associated light source, which will be discussed later) to tilt with respect to a vertical axis "y" to assume a desired tilted position. For example, FIG. 2A shows the adjustable lighting assembly 1 in the "down" position, in which a central axis X-X of the adjustable lighting assembly 1 is parallel with the vertical axis "y", while FIG. 2B shows the adjustable lighting assembly 1 in a tilted position in which the central axis X-X of the adjustable lighting assembly 1 is oriented at an angle "α" with respect to the vertical axis "y". In non-limiting embodiments the angle "α" is from 0-degrees to 45-degrees, though it will be appreciated that other angular ranges are contemplated. In some embodiments the adjustable lighting assembly 1 is infinitely adjustable within the range of angle "α".

Figure 3:
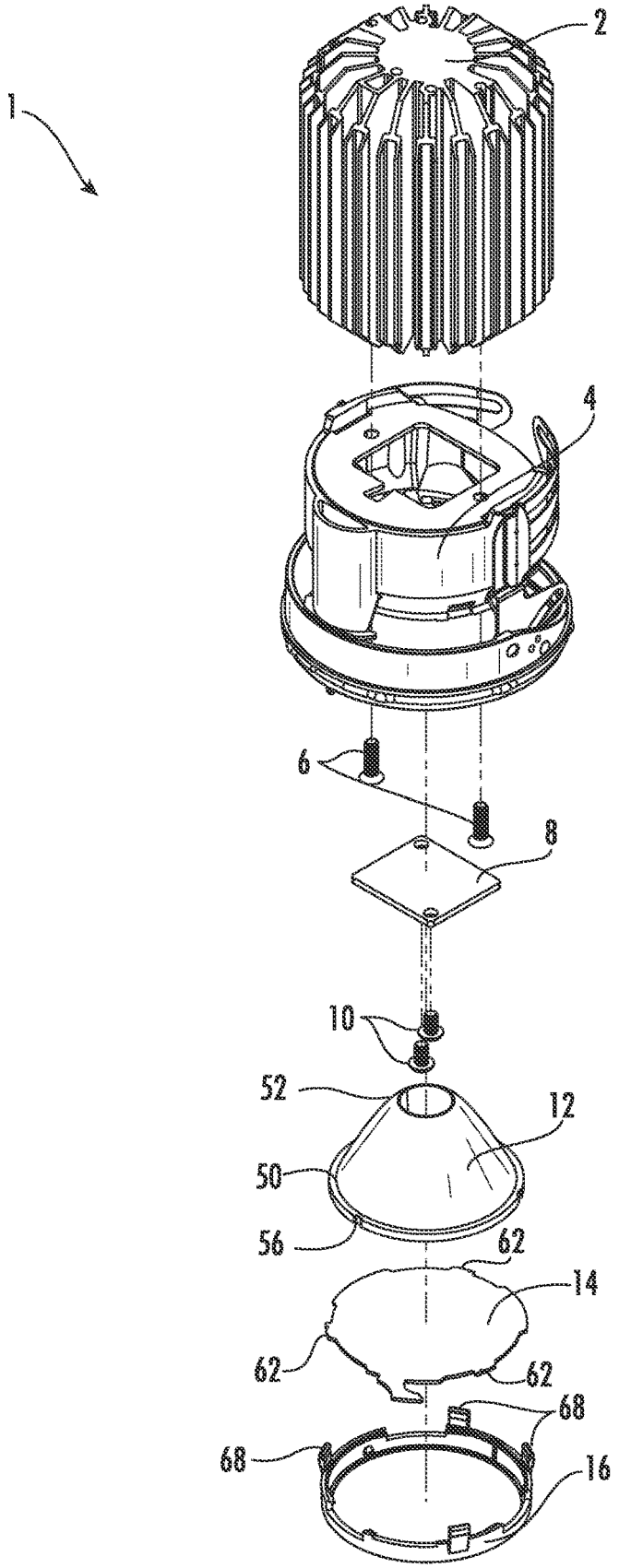
FIG. 3 is an exploded view of the example adjustable lighting assembly of FIG. 1.

FIG. 3 is an exploded view of a non-limiting example of the adjustable lighting assembly 1, illustrating the individual components thereof. As can be seen, heat sink 2 is couplable to the adjustment module portion 4 using one or more fasteners 6, although other mechanisms for coupling the heat sink 2 to the module 4 are envisioned. An LED chip 8 may be coupled to the heat sink using one or more fasteners 10, although other mechanisms for coupling the LED chip 8 to the heat sink 2 are envisioned. A primary optic 12 is receivable within the adjustment module portion 4. The primary optic 12 can be in the form of a reflector, a diffusion lens, a Fresnel lens, or the like. A secondary optic 14 is couplable with the adjustment module portion 4 so that is lies directly adjacent the primary optic 12. The secondary optic 14 can be a film-based lens used in conjunction with the primary optic 12 to provide additional light angles and/or the like and can be changed independent of the primary optic 12. An accessory holder 16 fits over the secondary optic 14 and, in one non-limiting example embodiment is coupled to the adjustment module 4 via a snap-fit connection or is otherwise releasably engaged with the adjustment module 4.

Figure 4:
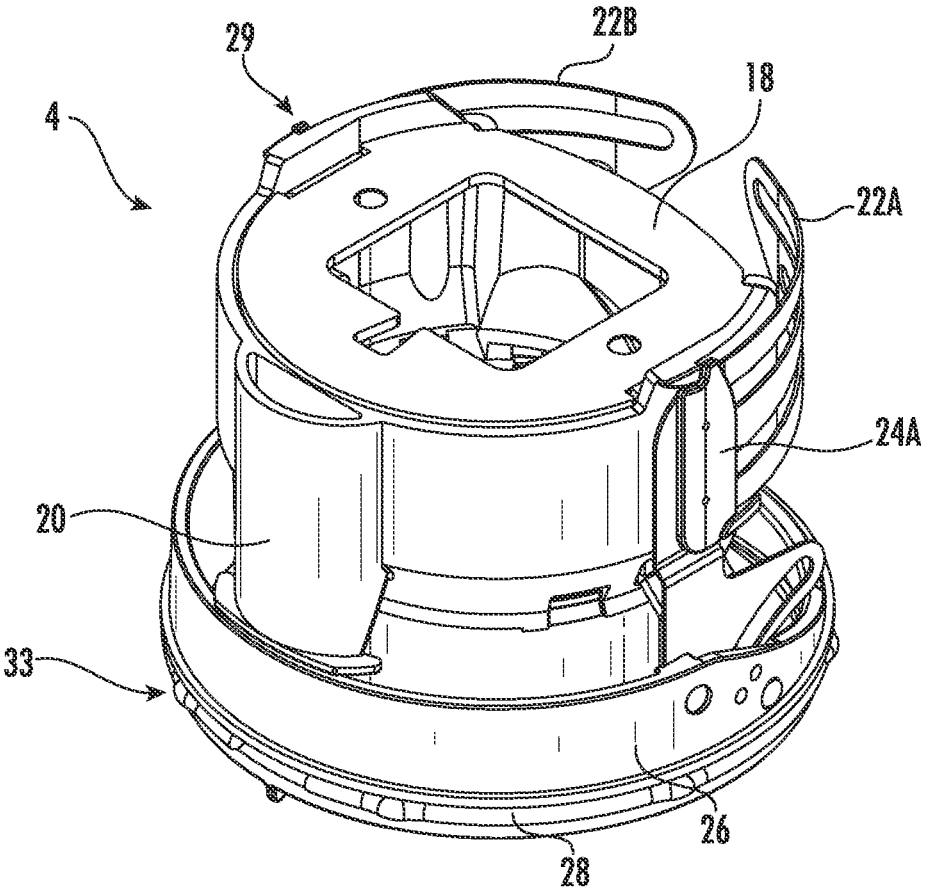
FIG. 4 is an isometric view of an adjustment module assembly portion of the example adjustable lighting assembly of FIG. 1.
Figure 5:
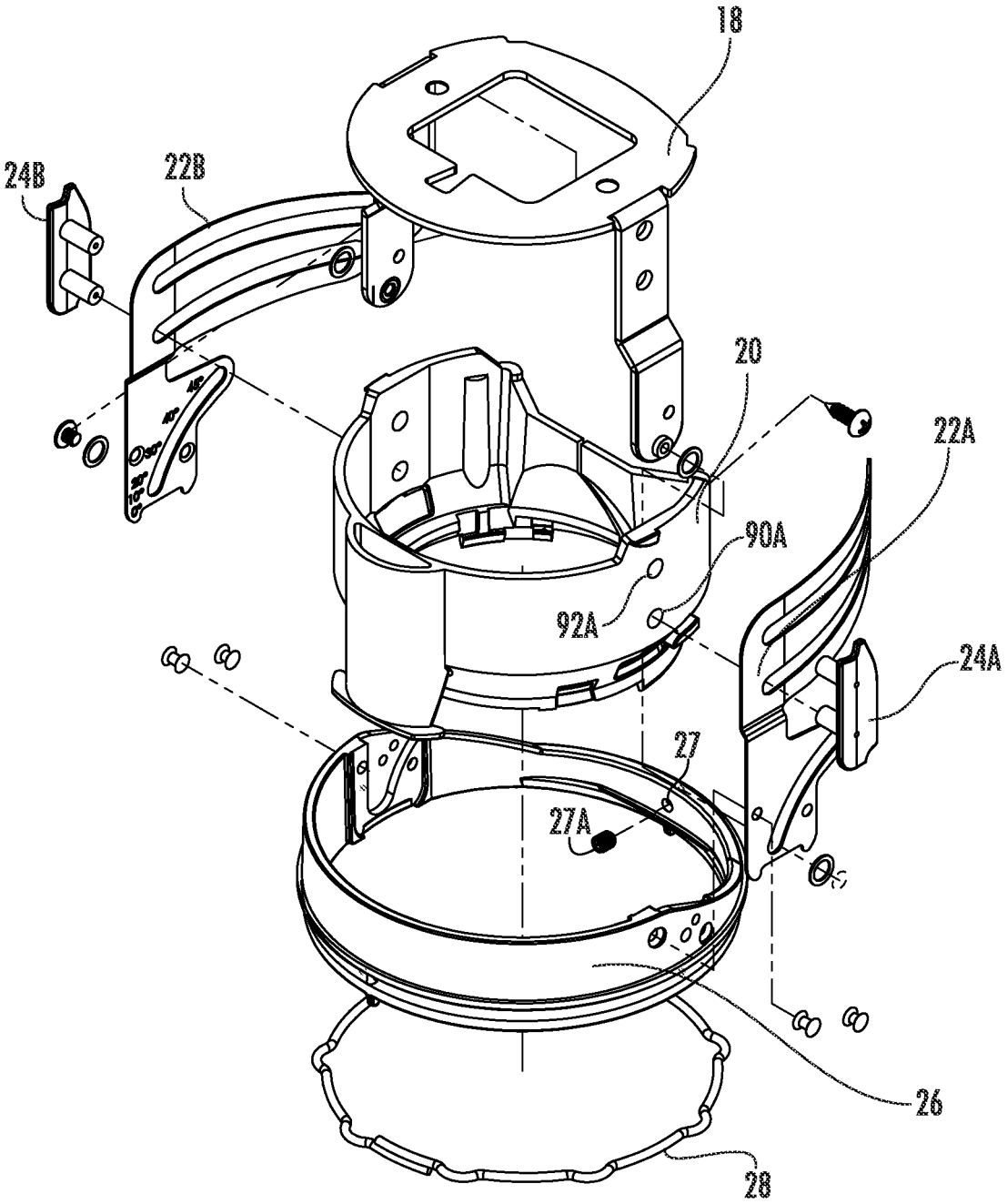
FIG. 5 is an exploded view of the adjustment module assembly portion of FIG. 4.

Referring now to FIGS. 4 and 5, a non-limiting example of an embodiment of the adjustment module portion 4 will be described in greater detail. As can be seen, the adjustment module portion 4 may include a module adjustment mounting bracket 18, an optic holder pivot core 20, a pair of pivot spring guide brackets 22A, 22B, a pair of pivot plates 24A, 24B, a collar spring mount 26, and a module mount retainer ring 28. At an upper end 29 of the adjustment module portion 4, the module adjustment mounting bracket 18 couples the adjustment module portion 4 to the heat sink 2 (FIG. 1), while at a lower end 33 of the adjustment module portion 4, the collar spring mount 26 and module mount retainer ring 28 couple the adjustment module portion 4 to an appropriate collar flange (to be discussed later) to couple the adjustable lighting assembly 1 to a plaster frame assembly installed above a ceiling.

Figure 6:
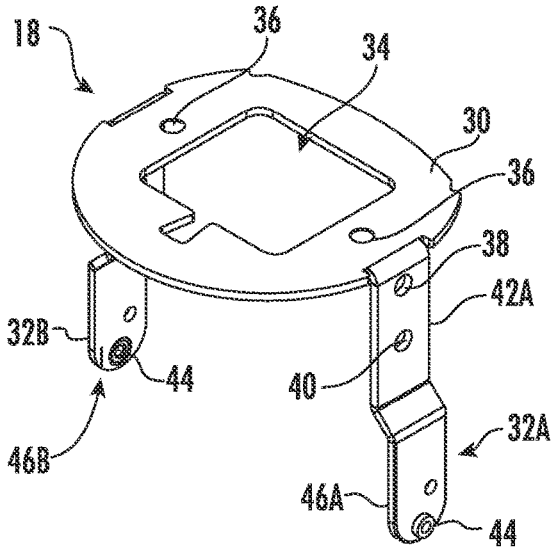
FIG. 6 is a module adjustment mounting bracket portion of the adjustment module assembly portion of FIG. 4.

Referring to FIGS. 5 and 6, a non-limiting example of an embodiment of the module adjustment mounting bracket 18 includes a plate portion 30 and a pair of leg portions 32A, 32B. The plate portion 30 includes an opening 34 for receiving the LED chip 8 (FIG. 3) and, in some non-limiting example embodiments, a rear portion of the primary optic 12 is received through the opening 34 The plate portion 30 includes fastener openings 36 for receiving fasteners 6 (FIG. 3) to couple the mounting bracket 18 to the heat sink 2 (FIG. 1). A plurality of fastener openings 38, 40 in an upper region 42A, 42B of the leg portions 32A, 32B are configured to receive appropriate fasteners to couple the mounting bracket 18 to the optic holder pivot core 20, while additional fastener openings 44 disposed in a lower region 46A, 46B of the leg portions 32A, 32B receive appropriate fasteners for pivotably coupling the mounting bracket 18 to the pivot spring guide brackets 22A, 22B, as will be described in greater detail later.

Figure 7:
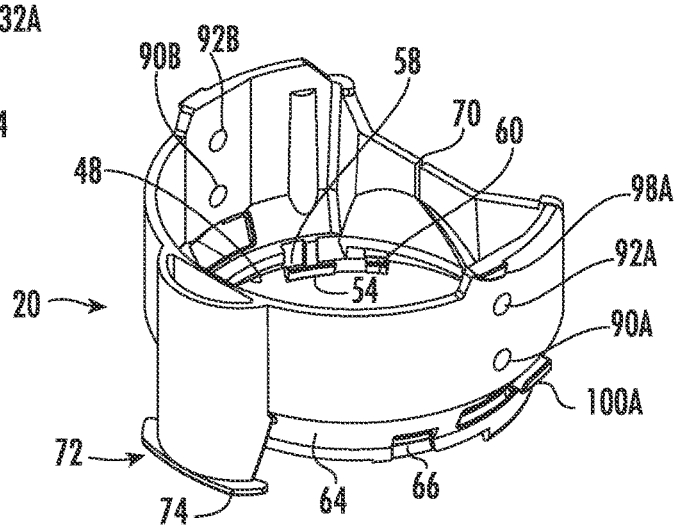
FIG. 7 is an optic holder pivot core portion of the adjustment module assembly portion of FIG. 4.

Referring to FIGS. 5 and 7, a non-limiting example of an embodiment of the optic holder pivot core 20 is configured to hold and position the primary optic 12 (FIG. 3) at a desired distance from the LED chip 8. In addition, the optic holder pivot core 20 may also include features for holding the secondary optic 14 and for engaging the accessory holder 16. In some embodiments, the optic holder pivot core 20 includes an interior circumferential lip 48 configured to abut a circumferential shoulder portion 50 (FIG. 3) of the primary optic 12 to position a rear end 52 of the primary optic at a predetermined axial distance from the LED chip 8. In addition, the optic holder pivot core 20 may have a plurality of tabs 54 positioned at spaced apart locations around the circumference of the optic holder pivot core 20. The plurality of tabs 54 may be engageable with a front surface 56 (FIG. 3) of the primary optic 12 to capture the primary optic 12 between the interior circumferential lip 48 and engagement surfaces 58 of the plurality of tabs 54 when the primary optic 12 is pressed past the tabs 54 and into engagement with the circumferential lip 48. It will be appreciated that the disclosed arrangement is one example embodiment for coupling the primary optic 12 to the optic holder pivot core 20, other arrangements now known or hereafter developed may be utilized.

The optic holder pivot core 20 may also include a second plurality of tabs 60, the second plurality of tabs 60 may be disposed adjacent to the plurality of tabs 54. The second plurality of tabs 60 may be used to engage corresponding surfaces 62 (FIG. 3) of the secondary optic 14 to removably couple the secondary optic 14 thereto. As shown, the optic holder pivot core 20 may also include a plurality of circumferentially-spaced recesses 66 formed in an outer surface 64 of the optic holder pivot core 20. The recesses 66 are configured to receive axially-extending tabs 68 (FIG. 1) of the accessory holder 16 to allow the accessory holder to be removably coupled to the optic holder pivot core 20. It will be appreciated that the secondary optic 14 and the accessory holder 16 are optional, such that the adjustable lighting assembly 1 may be used with or without one or both of them. In addition, it will be appreciated that the disclosed arrangement is one example embodiment for coupling the secondary optic 14 and the accessory holder 16 to the optic holder pivot core 20, other arrangements now known or hereafter developed may be utilized.

In one embodiment, the optic holder pivot core 20 is formed as a single piece molded polymer (e.g., plastic) construction, although the optic holder pivot core 20 may be formed from multiple pieces and/or different materials. To facilitate engagement of the primary optic 12 to the optic holder pivot core 20, the optic holder pivot core 20 may include at least one opening 70 (see FIG. 7) in a wall thereof to allow the core walls to flex outward upon application of suitable force to allow the primary optic 12 to be received therein. When the force is removed, the core walls may flex back inward, thereby capturing the primary optic 12 therein. A fastener may be used to span the opening 70 and, upon tightening, may prevent outward flexure of the core walls and to fix the primary optic 12 to the optic holder pivot core 20.

The optic holder pivot core 20 may also include a tilt adjustment feature 72 that allows a tool to be pressed against the tilt adjustment feature 72 to pivot the adjustable lighting assembly 1 by a desired amount after the adjustable lighting assembly 1 has been installed in a ceiling location. In the illustrated embodiment the tilt adjustment feature 72 includes a flange 74 having a recess for securely receiving a tool end so that a pivoting force can be applied to the optic holder pivot core 20 via the flange 74.

Figure 8A:
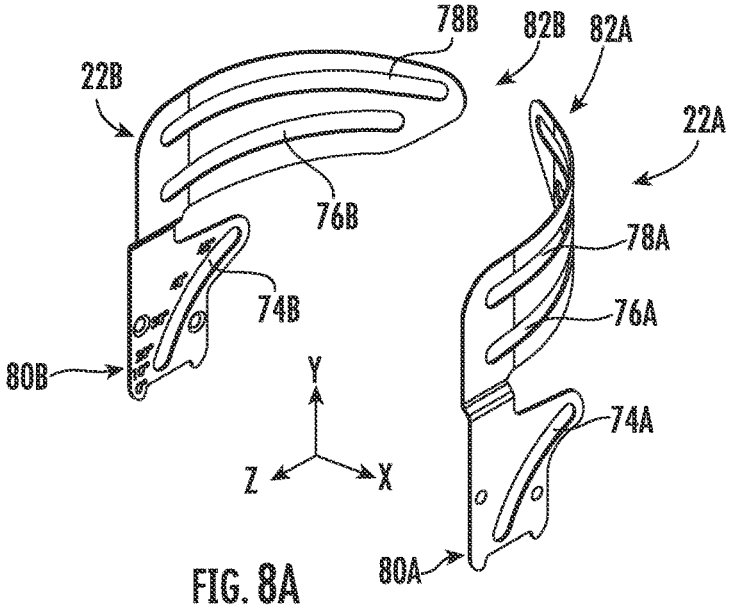
FIG. 8A is a pivot spring guide bracket portion of the adjustment module assembly portion of FIG. 4.

FIG. 8A shows a non-limiting example of an embodiment of first and second pivot spring guide brackets 22A, 22B which may be employed to adjust the tilt angle of the adjustable lighting assembly 1 by a desired amount. As shown, in one non-limiting example of an embodiment, each of the first and second pivot spring guide brackets 22A, 22B includes first, second and third guide slots 74A, 74B, 76A, 76B, 78A, 78B. Since the pivot spring guide brackets 22A, 22B are mirror images of one another, the description will proceed with respect to the first pivot spring guide bracket 22A. It will be appreciated, however, that the same description will apply to the second pivot spring guide bracket 22B.

Figure 8B:
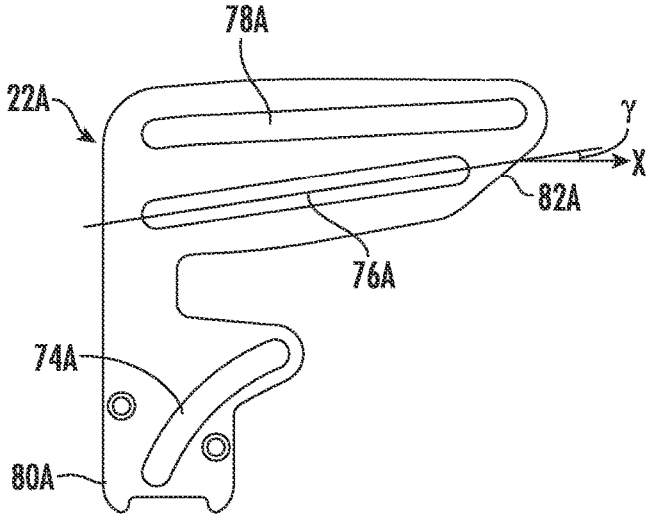
FIGS. 8B-F are various views of the pivot spring guide bracket portion of FIG. 8A.
Figure 8C:
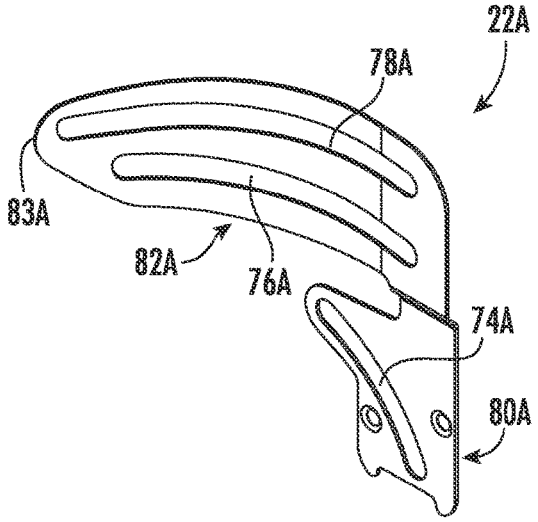
Figure 8D:
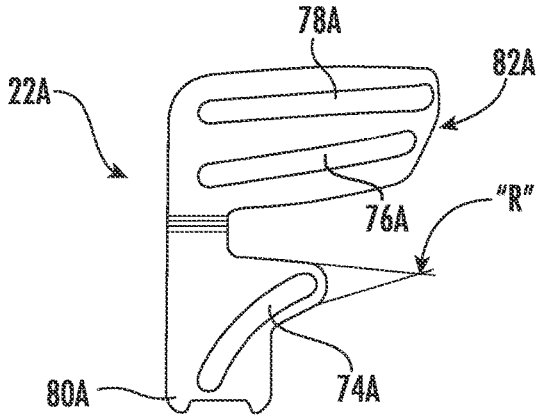
Figure 8E:
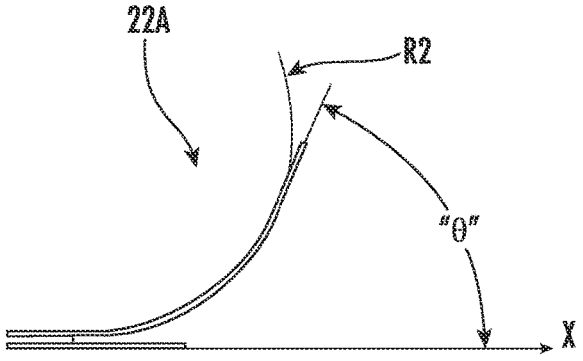

Referring to FIGS. 8B-F, the first guide slot 74A may be disposed in a lower portion 80A of the pivot spring guide bracket 22A, while the second and third guide slots 76A, 78A may be disposed in an upper portion 82A of the bracket. In one non-limiting example of an embodiment, the first guide slot 74A is in the shape of an arc having a radius "R" that is, in one non-limiting example embodiment, 0.94-inches. The second guide slot 76A is linear, and in one non-limiting example embodiment, is oriented at an angle "γ" of 8.4 degrees from the x-axis, and the third guide slot 78A is in the shape of an elongated S-shaped spline, the details of which will be described later. FIG. 8B illustrates the pivot spring guide bracket 22A in a flattened condition, though in use the bracket will assume the curved configuration illustrated in FIGS. 8C-F. As can be seen in FIG. 8E, the upper portion 82A of the pivot spring guide bracket 22A can have a curve radius "R2" that is, in one non-limiting example embodiment, 1.02 inches. A distal tip 83A of the upper portion 82A of the pivot spring guide bracket 22A may form an angle "θ", which in one non-limiting example embodiment, is about 68-degrees from the x-axis.

Figure 8F:
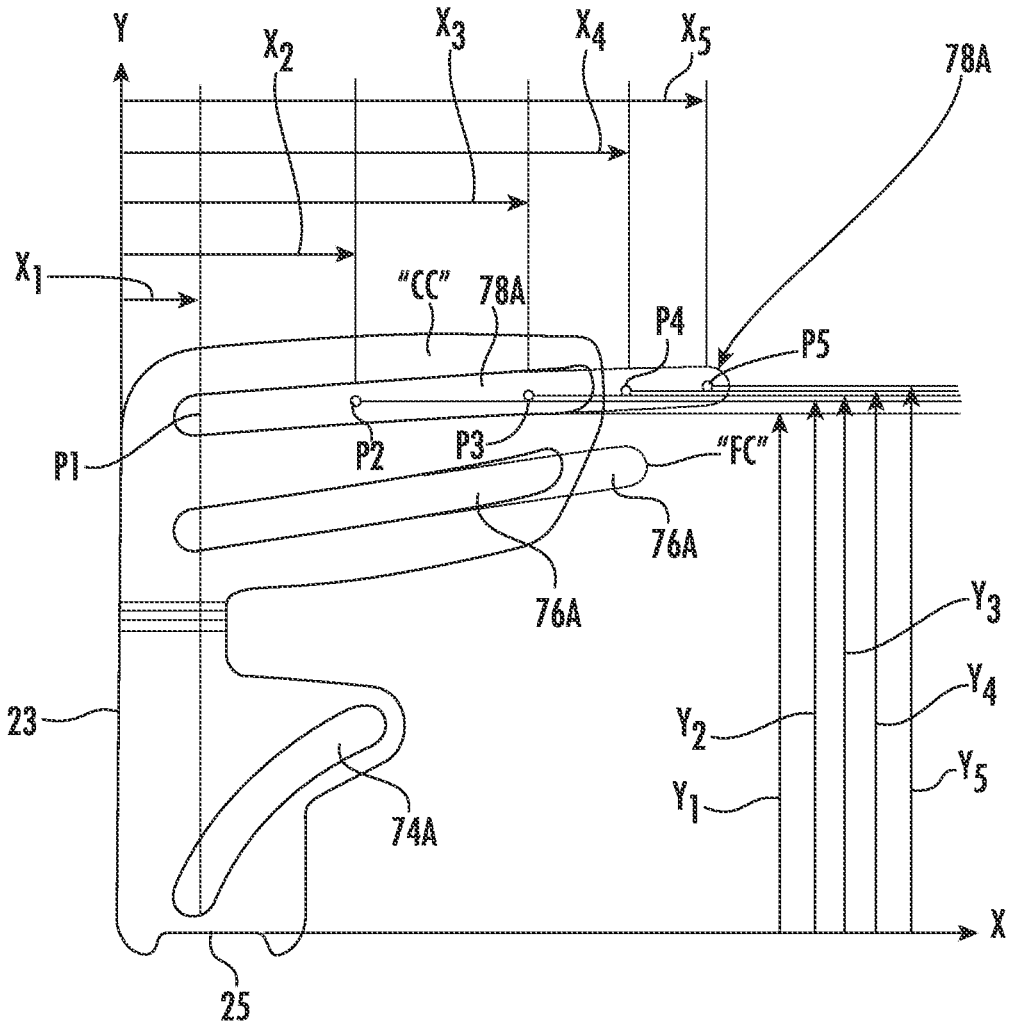

FIG. 8F shows the configuration of the third guide slot 78A, which, as previously mentioned, is formed as an S-shaped spline. For ease of description, FIG. 8F shows the third guide slot 78A in both the curved configuration "CC" and the flattened configuration "FC". Reference dimensions are provided in relation to the flattened configuration "FC" since that is the configuration in which the third guide slot 78A will be formed. In addition, non-limiting example reference dimensions are provided for five different points $P_1$-$P_5$ distributed along the length of the third guide slot 78A, in order to describe the shape of the illustrated embodiment. As will be appreciated, dimensions $X_1$-$X_5$ represent distances from the y-axis, which is disposed along a first side edge 23 of the pivot spring guide bracket 22A, while dimensions $Y_1$-$Y_5$ represent distances from the x-axis, which is disposed along a bottom edge 25 of the pivot spring guide bracket.

In a non-limiting example embodiment, point $P_1$ is located at $X_1$, $Y_1$; point $P_2$ is located at $X_2$, $Y_2$; point $P_3$ is located at $X_3$, $Y_3$; point $P_4$ is located at $X_4$, $Y_4$; and point $P_5$ is located at $X_5$, $Y_5$. In a non-limiting example embodiment, $X_1$=0.23 in, $Y_1$=1.55 in; $X_2$=0.71 in, $Y_2$=1.59 in; $X_3$=1.23 in, $Y_3$=1.61 in; $X_4$=1.52 in, $Y_4$=1.62 in; $X_5$=1.76 in, $Y_5$=1.64 in. It will be appreciated that other s-shaped spline arrangements can be used for the third guide slot 78A, in the addition to the illustrated embodiment.

It will be appreciated, that while the first and second pivot spring guide brackets 22A, 22B have been shown and described as including first guide slots 74A, 74B, second guide slots 76A, 76B, and third guide slots 78A, 78B, it is envisioned that the first and second pivot spring guide brackets 22A, 22B may include more or less guide slots including, for example, two, four, or more.

The described combination of guide slots allow a specific desired range of motion for the adjustable lighting assembly 1. As will be appreciated, a design including only two-slots would allow for free movement outside the specific desired range of motion. Two of the guide slots comprise paths that control tilt angle while the third guide slot prevents undesirable free movement of the assembly. The geometry and arrangement of the guide slots is independent of ceiling thickness, and specific guide slot geometries can be scaled for use in larger ceiling aperture applications.

The first guide slot 74A is configured to receive a fastener, pin, or the like (used interchangeably herein without the intent to limit) disposed in the fastener opening 44 disposed in a lower region 46A of the leg portion 32A of the module adjustment mounting bracket 18. It will be appreciated that although the design is described as having a fastener opening and a separate fastener, it is contemplated that the fasteners could be fixed and/or integral to the leg portions 32A. The second guide slot 76A is configured to receive a fastener disposed in the fastener opening 40 in the upper region 42A of the leg portion 32A of the module adjustment mounting bracket 18. The third guide slot 78A is configured to receive a fastener disposed in the fastener opening 38 in the upper region 42A of the leg portion 32A of the module adjustment mounting bracket 18.

As will be described in greater detail later, in use, the pivoting movement obtained using the first, second and third guide slots 74A, 76A, 78A, with each guide slot including a different configuration, minimizes changes in distance between the LED chip 8 and ceiling opening that can occur as the adjustable lighting assembly 1 is tilted. As will be appreciated, the primary optic 12 produces a beam of light, which in one non-limiting example embodiment has a conical shape. With a conical beam shape, the greater the distance from the LED chip 8 to the ceiling opening, the greater the size of the light cone. By minimizing changes in the distance between the LED chip 8 and the ceiling opening as the adjustable lighting assembly 1 is tilted, the amount of light through the opening is maximized.

As can be seen, in one embodiment, the pivot spring guide brackets 22A, 22B have a curved shape when viewed from above (i.e., they are curved about the y-axis). In some embodiments, the pivot spring guide brackets 22A, 22B are made from spring steel. The curved geometry of the brackets 22A, 22B is such that as the adjustable lighting assembly 1 pivots, the optic holder pivot core 20 moves laterally to engage the curved portions of the brackets 22A, 22B, forcing them apart. The spring force applied to the optic holder pivot core 20 acts as a detent tending to hold the adjustable lighting assembly 1 in the tilted position without the need for any further locking feature.

Figure 9:
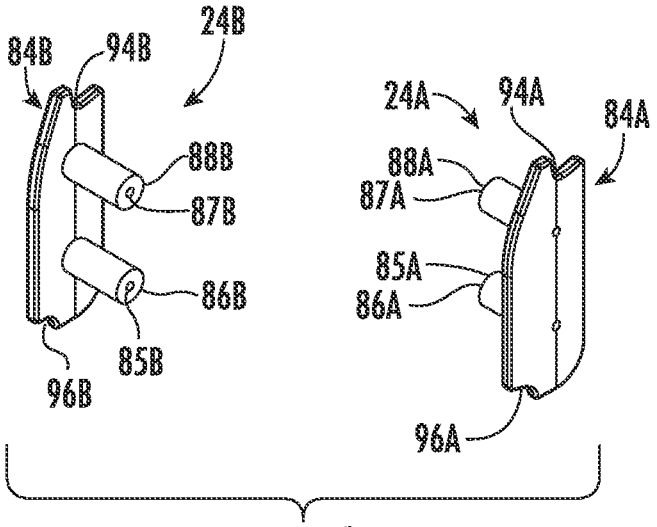
FIG. 9 is an outside bushing pivot plate portion of the adjustment module assembly portion of FIG. 4.

FIG. 9 shows a non-limiting example of an embodiment of first and second pivot plates 24A, 24B, each including a plate portion 84A, 84B and first and second projections 86A, 86B; 88A, 88B which are vertically spaced apart from one another. In use, the first and second projections 86A, 86B; 88A, 88B are configured to be received through the second and third slots 76A, 76B; 78A, 78B of the pivot spring guide brackets 22A, 22B, through respective first and second openings 90A, 90B; 92A, 92B in the optic holder pivot core 20, and through fastener openings 38, 40 in the upper region 42A, 42B of the leg portions 32A, 32B of the mounting bracket 18. Fasteners (not shown) within the optic holder pivot core 20 can engage openings 85A, B; 87A, B in the first and second projections 86A, 86B; 88A, 86B to secure the module adjustment mounting bracket 18 to the optic holder pivot core 20, while allowing the first and second projections 86A, 86B; 88A, 86B to slide within the second and third slots 76A, 76B; 78A, 78B of the pivot spring guide brackets 22A, B to facilitate tilting of the adjustable lighting assembly 1.

The first and second pivot plates 24A, B may each have anti-rotation features to prevent them from rotating and/or binding while the adjustable lighting assembly 1 is being tilted. In one embodiment, the anti-rotation features include first and second recesses 94A, 94B, 96A, 96B disposed at opposite ends of the plates 24A, 24B. The first and second recesses 94A, 94B, 96A, 96B interact with first and second projections 98A, 98B, 100A, 100B disposed on the optic holder pivot core 20 directly adjacent to the first and second openings 90A, 90B, 92A, 92B. That is, forces applied to the first and second pivot plates 24A, B during adjustment of the adjustable lighting assembly 1 can tend to rotate the pivot plates. Such rotational forces will cause the first and second recesses 94A, 94B, 96A, 96B to engage the first and second projections 98A, 98B, 100A, 100B, thus preventing actual rotation of the pivot plates.

Figure 10:
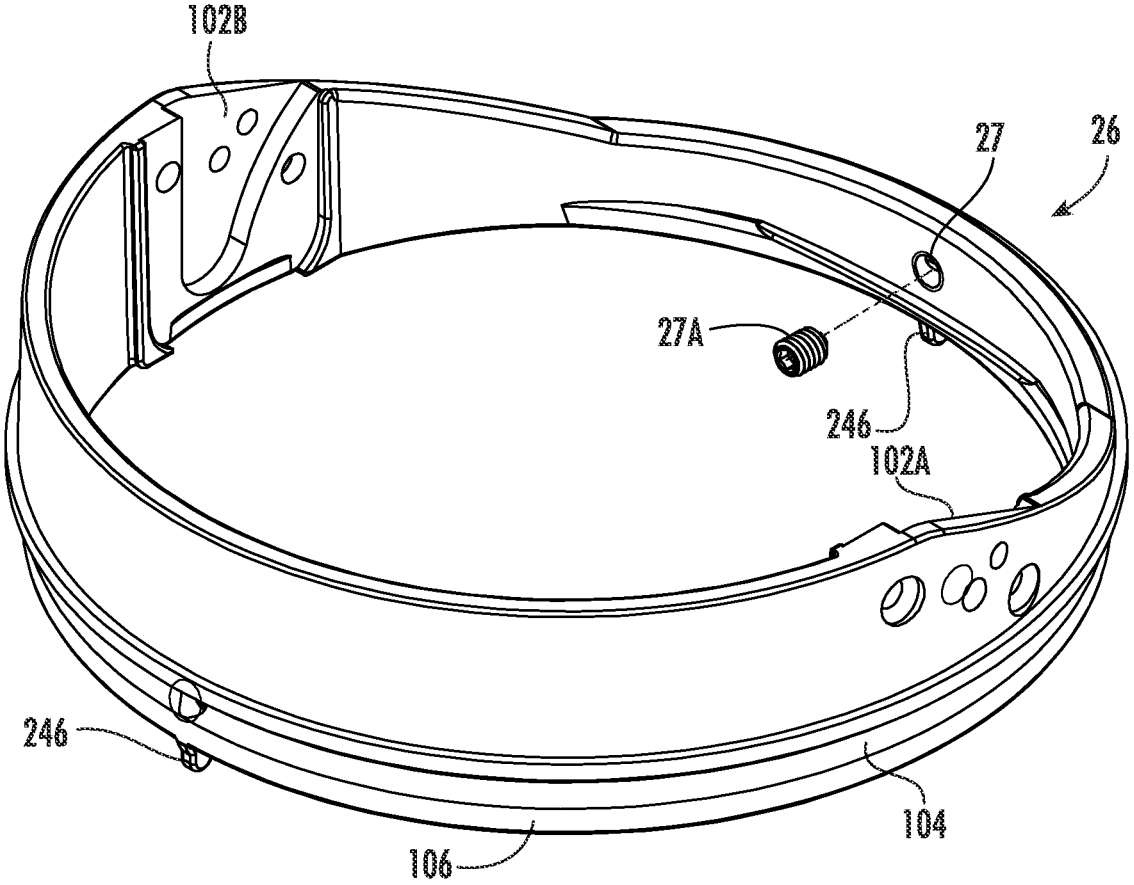
FIG. 10 is a collar spring mount pivot center portion of the adjustment module assembly portion of FIG. 4.
Figure 11A:
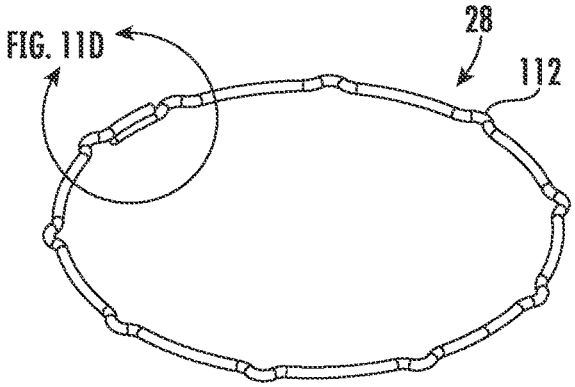
FIGS. 11A-11E are various views of a module mount retainer ring portion of the adjustment module assembly portion of FIG. 4.
Figure 11B:
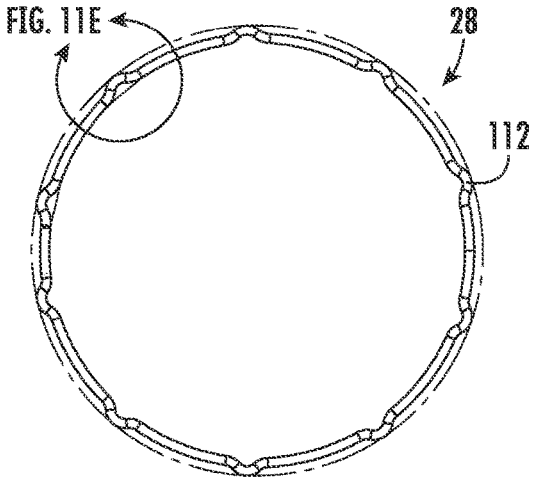
Figure 11C:
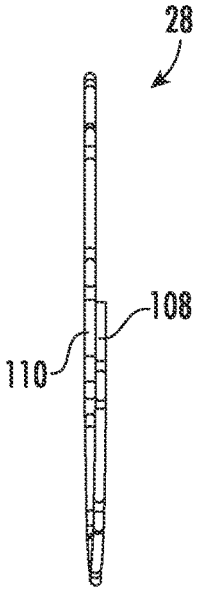
Figure 11D:
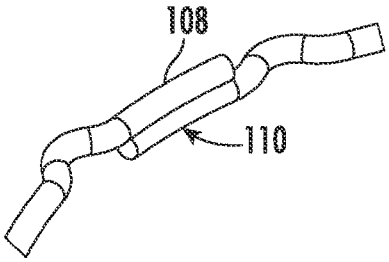
Figure 11E:
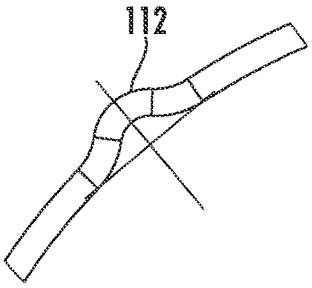

FIG. 10 shows a non-limiting example of an embodiment of the collar spring mount 26, which, as shown, may be a generally cylindrical member having diametrically opposed recesses 102A, 102B for receiving the lower portions 80A, 80B of the first and second pivot spring guide brackets 22A, 22B. The first and second pivot spring guide brackets 22A, 22B can be fixed to the collar spring mount 26 using fasteners or other suitable attachment mechanisms. The collar spring mount 26 may also have a circumferential groove 104 disposed on an external surface 106. In use, the circumferential groove 104 may be configured to receive the module mount retaining ring 28 therein (see FIG. 4).

FIGS. 11A-E show a non-limiting example of an embodiment of the module mount retaining ring 28, which in one embodiment, is a spring wire formed in a circular shape. A pair of overlapping end portions 108, 110 allow the module mount retaining ring 28 to expand and contract as a spring. The module mount retaining ring 28 may include a plurality of discontinuities 112 along its circumference. In the illustrated embodiment these discontinuities 112 take the form of a radial outward "bump". As will be described in greater detail below, these discontinuities 112 are employed to create a frictional engagement with an associated flange assembly such as, for example, collar flange assembly 114, 116 described below, to couple the adjustable lighting assembly 1 to a frame subassembly which is mounted to a ceiling. In use, the module mount retaining ring 28 enables the adjustable lighting assembly 1 to be rotationally adjusted with respect to the frame subassembly, and hence the ceiling. Once properly positioned, the friction engagement between the module mount retaining ring 28 and the frame subassembly holds the adjustable lighting assembly 1 in a desired rotational position without the need for a separate locking mechanism.

In one embodiment, referring to FIG. 10, the collar spring mount 26 may include a threaded opening 27 for receiving a set screw 27A. In use, the set screw 27A is arranged and configured to interact with the retaining ring 28 so that tightening the set screw 27A expands the retaining ring 28 thereby tightening the retaining ring 28 against the collar spring mount 26. Thus arranged, tightening the set screw 27A facilitates increased frictional engagement between the retaining ring 28 and the frame subassembly to hold the adjustable lighting assembly 1 in a desired rotational position.

Figure 12A:
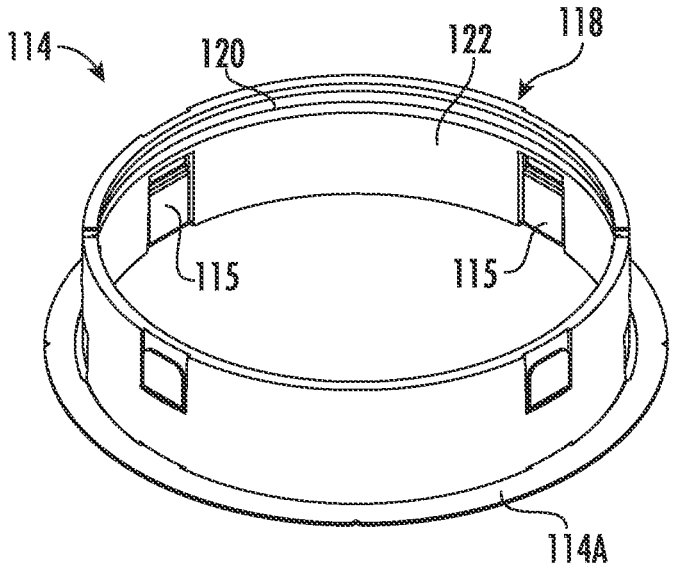
FIGS. 12A and 12B show a round and square collar flange assemblies, respectively, for use with the adjustable lighting assembly of FIG. 1.
Figure 12B:
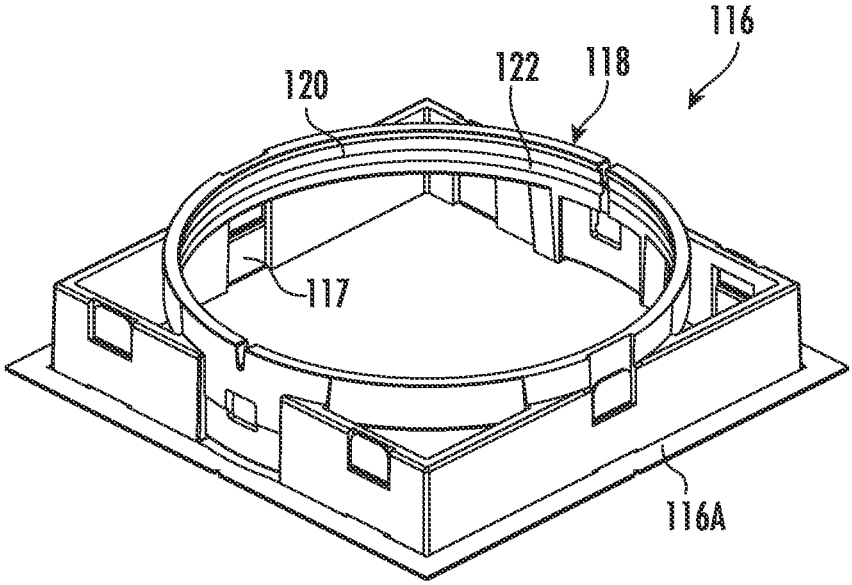

FIGS. 12A and 12B show a non-limiting example of an embodiment of a collar flange assembly. As shown, the collar flange assembly may be in the form of a round collar flange assembly 114 or a square collar flange assembly 116, both of which are releasably couplable to the adjustable lighting assembly 1 via the collar spring mount 26 and module mount retaining ring 28. As mentioned, the round and square collar flange assemblies 114, 116 connect the adjustable lighting assembly 1 to a frame subassembly which itself is mounted to a ceiling.

As will also be appreciated, the round collar flange assembly 114 can be used to accommodate round ceiling trim elements (via, for example, a series of interior recesses 115 which spring clips of the trim element can engage), while the square collar flange assembly 116 can be used to accommodate square ceiling trim elements (again, via, for example, a series of interior recesses 117 which spring clips of the trim element can engage). Each of the round and square collar flange assemblies 114, 116 has a circular coupling portion 118 for receiving the collar spring mount 26 therein. The round collar flange assembly 114 also has a round flange portion 114A, while the square collar flange assembly 116 has a square flange portion 116A for engaging associated trim elements. The circular coupling portion 118 has a circumferential groove 120 disposed on an inner surface 122 thereof for receiving the module mount retaining ring 28 to axially lock the round or square collar flange assembly 114, 116 to the adjustable lighting assembly 1. Although axially locked, the adjustable lighting assembly 1 remains rotatable with respect to the round or square collar flange assembly 114, 116.

In some embodiments, the adjustable lighting assembly 1 is selectively rotatable and provisionally lockable in any of a variety of desired rotational positions with respect to the round or square collar flange assembly 114, 116. This feature allows the installer to adjust the direction in which light is projected from the adjustable lighting assembly 1, and to provisionally lock or hold the adjustable lighting assembly 1 in the desired position without the need for an additional locking element. In some embodiments, the provisional locking feature is facilitated by the discontinuities 112 in the module mount retaining ring 28 which, when installed, engage inner surfaces within the circumferential groove 120 of the circular coupling portion 118. The spring forces generated by the discontinuities 112 (when coupled within the groove 120) provide increased frictional engagement between the module mount retaining ring 28 and the inner surfaces of the circumferential groove 120. The frictional forces tend to inhibit rotational movement of the adjustable lighting assembly 1 with respect to the round or square collar flange assembly 114, 116. The rotational position still can be adjusted by a user applying sufficient rotational force to overcome the frictional forces caused by the discontinuities 112. The disclosed arrangement thus provides a range of adjustable, and re-adjustable, rotational positioning of the adjustable lighting assembly 1 with respect to the ceiling.

As will be described in greater detail later, the round and square collar flange assemblies 114, 116 include features for coupling the round and square collar flange assemblies 114, 116 to a frame subassembly that itself is mounted in or on a ceiling.

Figure 13A:
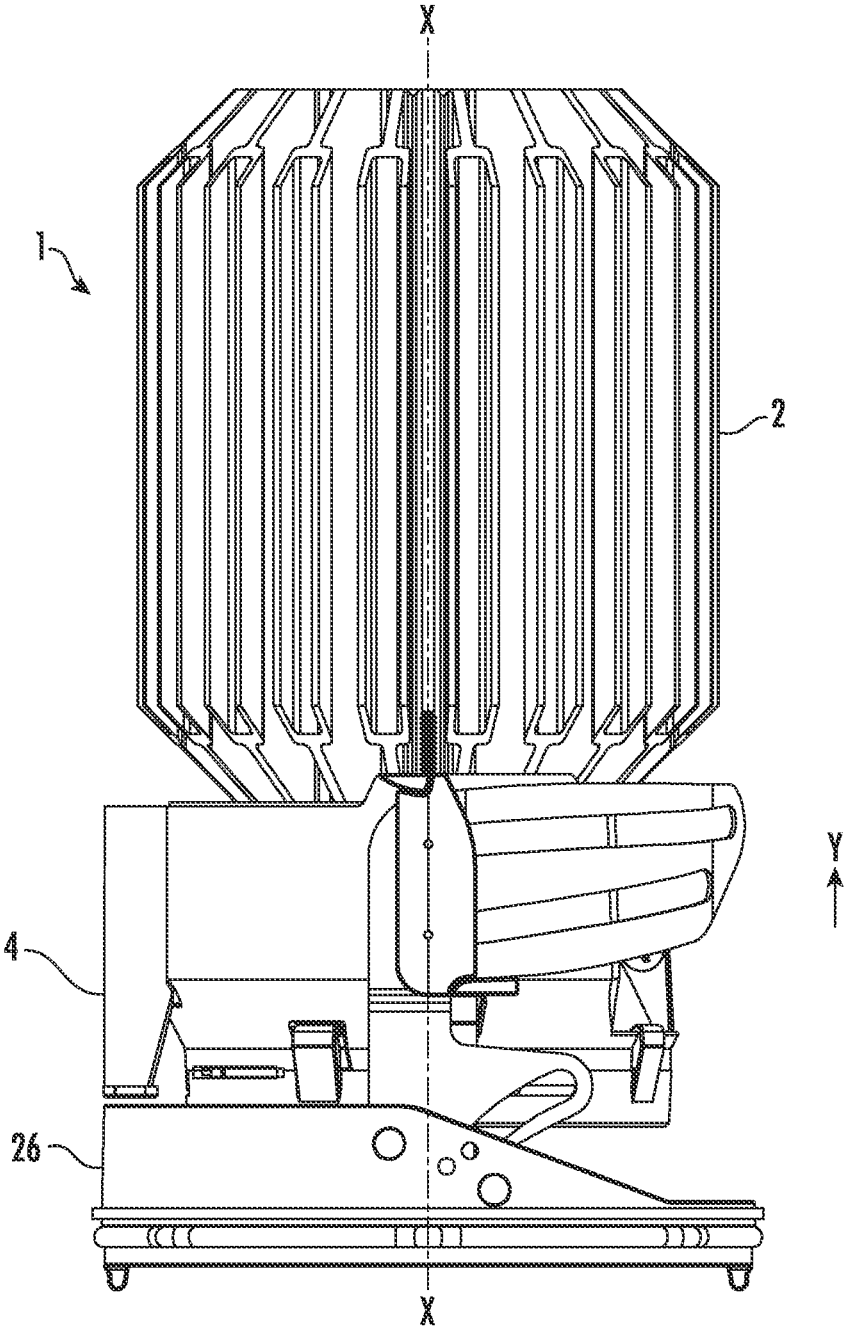
FIG. 13A-C are side views of the example adjustable lighting assembly of FIG. 1 in various tilted configurations.
Figure 13B:
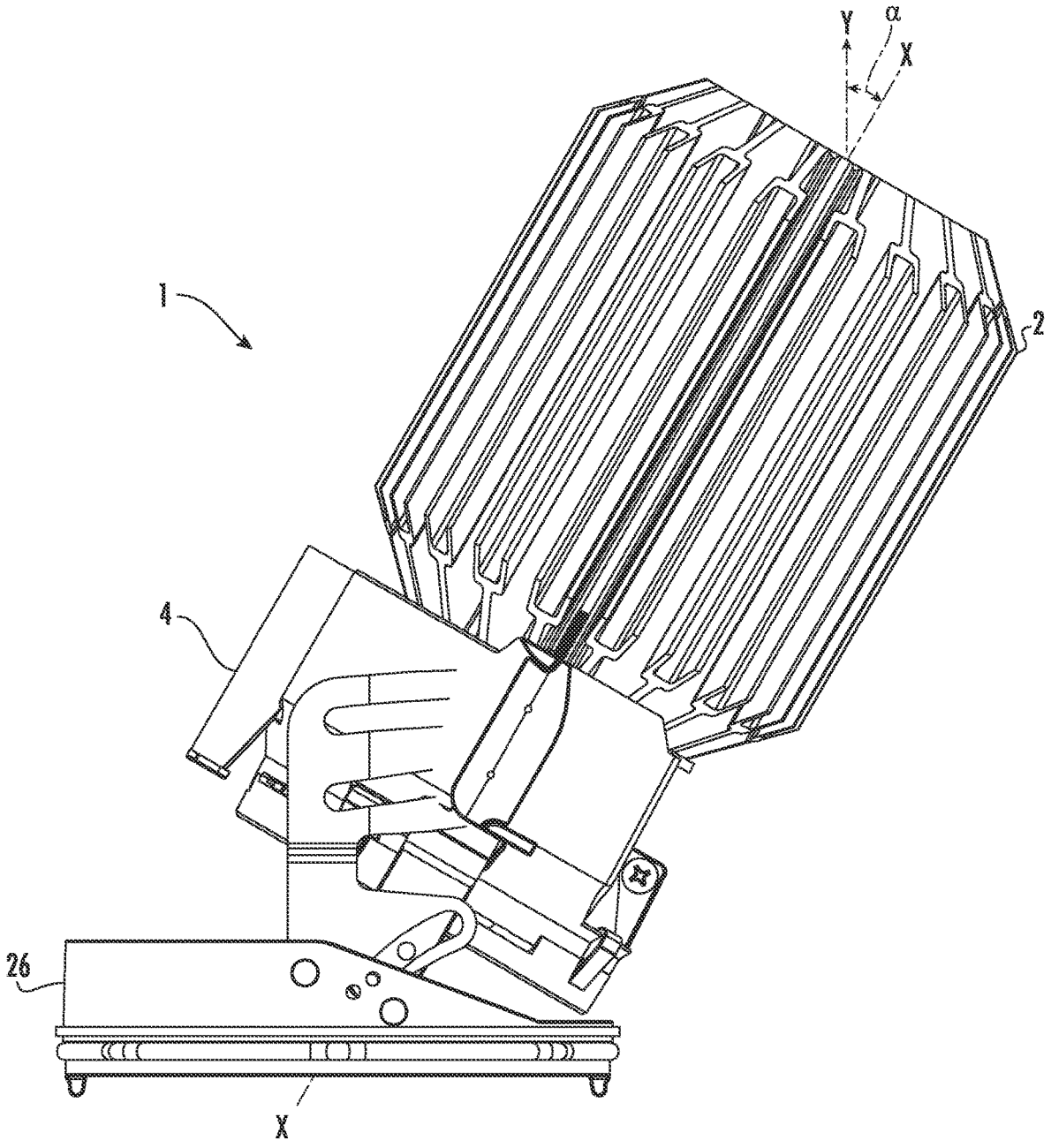
Figure 13C:
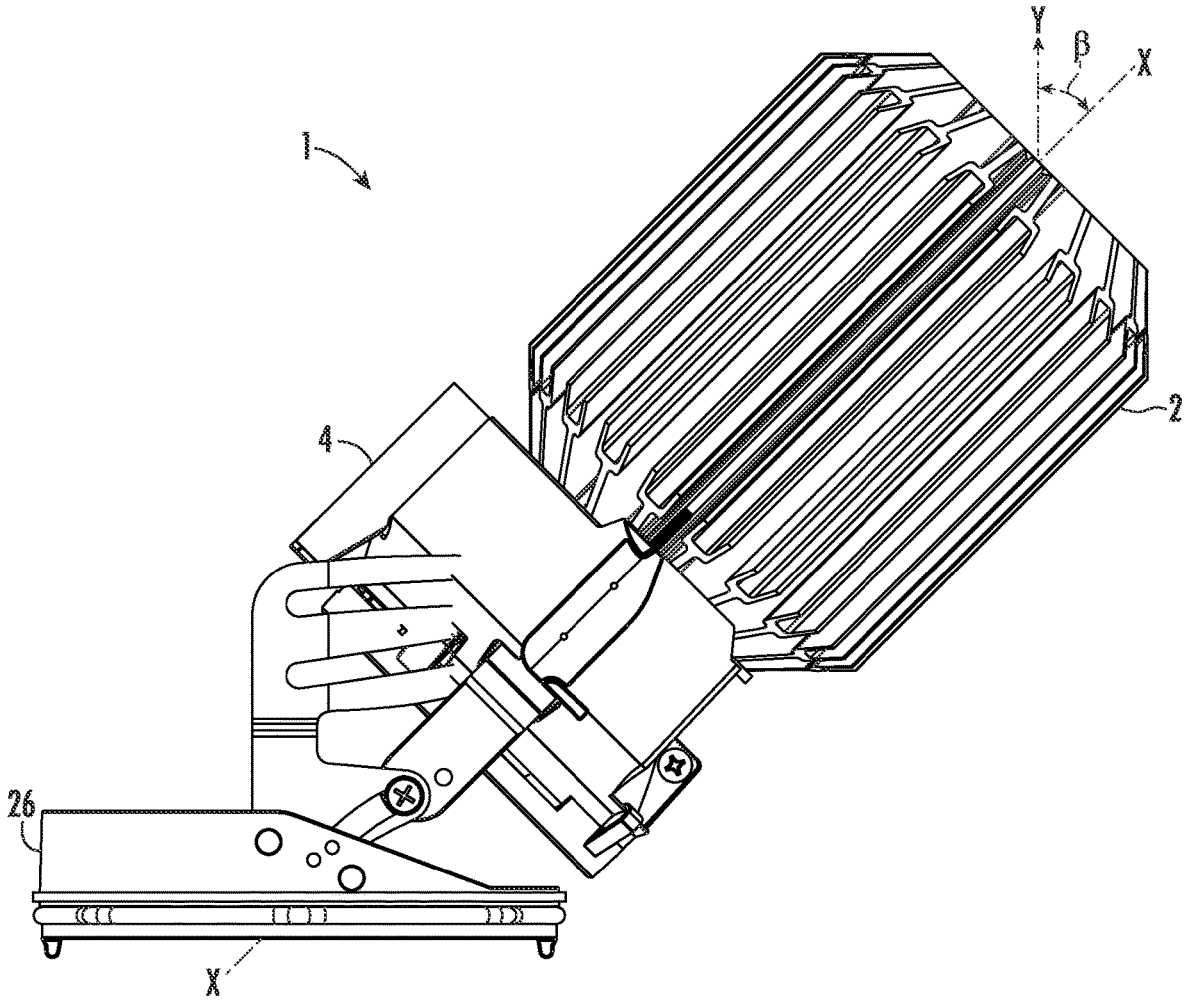

Referring now to FIGS. 13A-13C, the adjustable lighting assembly 1 is configured to be positioned in a variety of tilt angles for providing a light cone at a desired angle with respect to an opening in a ceiling. In non-limiting example embodiments, the tilt angles can range between 0-degrees and 45-degrees. It will be appreciated, however, that these ranges are not critical, and that other tilt angle ranges may be accommodated. FIG. 13A shows the adjustable lighting assembly 1 in the "down" position, in which the central axis X-X of the adjustable lighting assembly 1 is parallel to the vertical axis "y". FIG. 13B shows the adjustable lighting assembly 1 in a first angled configuration in which the central axis X-X of the adjustable lighting assembly 1 is oriented at an angle "α" with respect to the vertical axis "y". FIG. 13C shows the shows the adjustable lighting assembly 1 in a second angled configuration in which the central axis X-X of the adjustable lighting assembly 1 is oriented at an angle "β" with respect to the vertical axis "y", where "β" is greater than "α". In some embodiments, angle "α" is 22.5 degrees, while angle "β" is 45 degrees. It will be appreciated that these tilt increments are merely examples, and that the adjustable lighting assembly 1 can be tilted at virtually any angle between the "down" position and a maximum tilt position (which in one non-limiting example embodiment is 45-degrees from the vertical axis "y").

As can be seen, as the adjustable lighting assembly 1 tilts, the heat sink 2 and the adjustment module portion 4 (and associated pieces) tilt, while the collar spring mount 26 remains stationary (since the collar spring mount 26 is coupled to a frame subassembly which itself is mounted to the ceiling). In addition, as the adjustable lighting assembly 1 tilts, the distance from the center of the primary optic 12 to the room side of the ceiling (138, see FIG. 14A) is maintained constant across the entire range of motion.

Figures 14A, 14B, 14C, 14D, 14E:
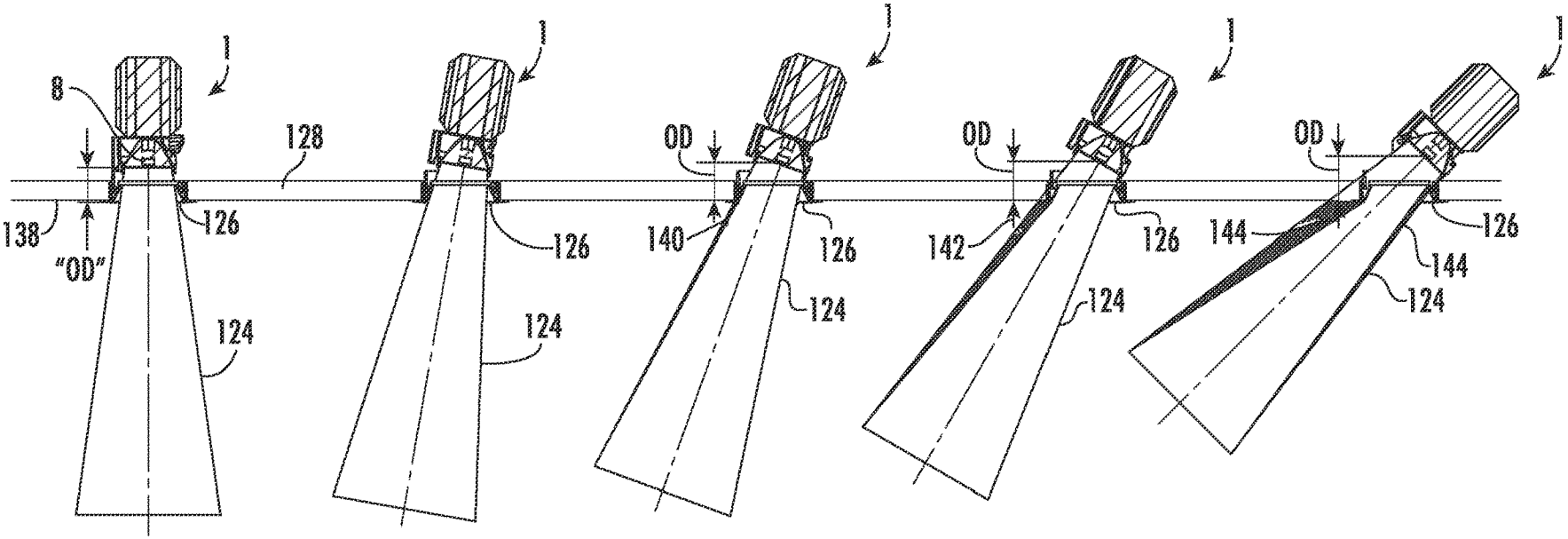
FIGS. 14A-E are side view of the example adjustable lighting assembly of FIG. 1 in the context of a ceiling and ceiling opening, where the adjustable lighting assembly is positioned in various tilted configurations.

FIGS. 14A-E show the adjustable lighting assembly 1 is positioned in a variety of tilt angles for providing a light cone 124 at a desired angle with respect to an opening 126 in a ceiling 128. As can be seen, in the "down" position shown in FIG. 14A, the LED chip 8 is disposed a predetermined offset distance "OD" from the bottom surface 138 of the ceiling 128. At this predetermined offset distance "OD" the light cone 124 passes through the opening 126 such that none, or little, of the light cone is blocked by the ceiling 128. FIG. 14B shows the adjustable lighting assembly 1 in a first tilted position (e.g., 10-degree position) in which the light cone 124 also passes through the opening 126 and none, or little, of the light cone is blocked by the ceiling 128. FIG. 14C shows the adjustable lighting assembly 1 in a second tilted position (e.g., 20-degree position) in which the light cone 124 passes through the opening 126 such that a first portion 140 of the light cone may be blocked by the ceiling 128. FIG. 14D shows the adjustable lighting assembly 1 in a third tilted position (30-degree position) in which the light cone 124 passes through the opening 126 such that a second portion 142 of the light cone may be blocked by the ceiling 128. FIG. 14E shows the adjustable lighting assembly 1 in a fourth tilted position (45-degree, or "max" position) in which the light cone 124 passes through the opening 126 such that a third portion 144 of the light cone 124 may be blocked by the ceiling 128. In the illustrated embodiments, the adjustable lighting assembly 1 serves to minimize the change in the offset distance "OD" (i.e., the distance between the LED chip 8 and the bottom surface 138 of the ceiling 128) as the adjustable lighting assembly 1 adjusts between the "down" position (FIG. 14A) and the fourth tilted position (FIG. 14E) so as to maximize the amount of light that passes through the opening 126 in the ceiling 128.

Figure 15:
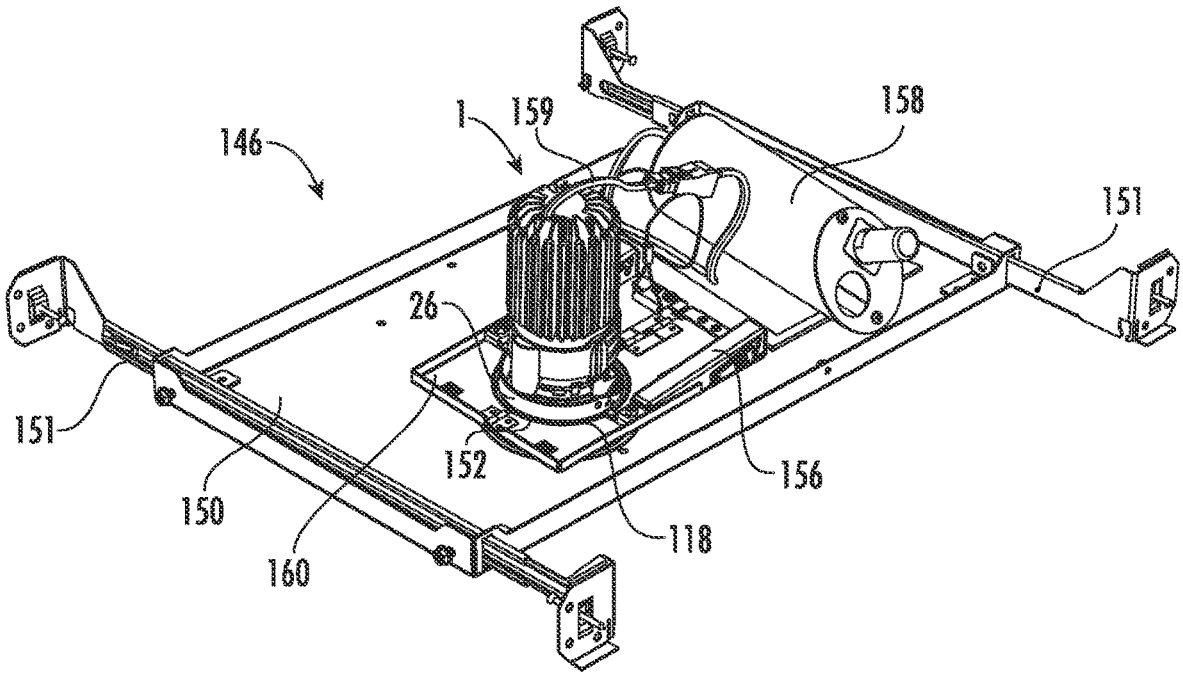
FIG. 15 is an isometric view of the example adjustable lighting assembly of FIG. 1 coupled to an example frame subassembly and J-box assembly for new construction applications.
Figure 16A:
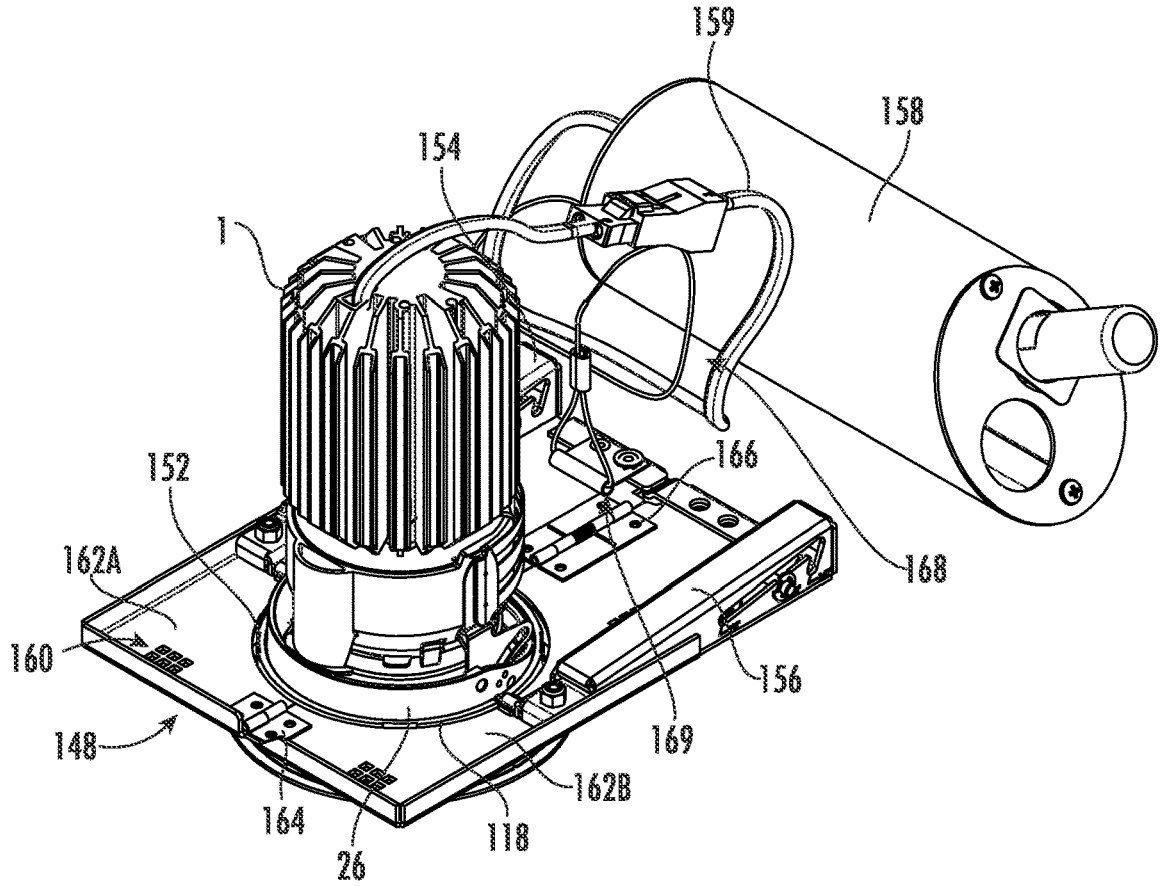
FIGS. 16A and 16B are isometric and side views, respectively, of the example adjustable lighting assembly of FIG. 1 coupled to an example frame subassembly and J-box assembly for remodel applications.
Figure 16B:
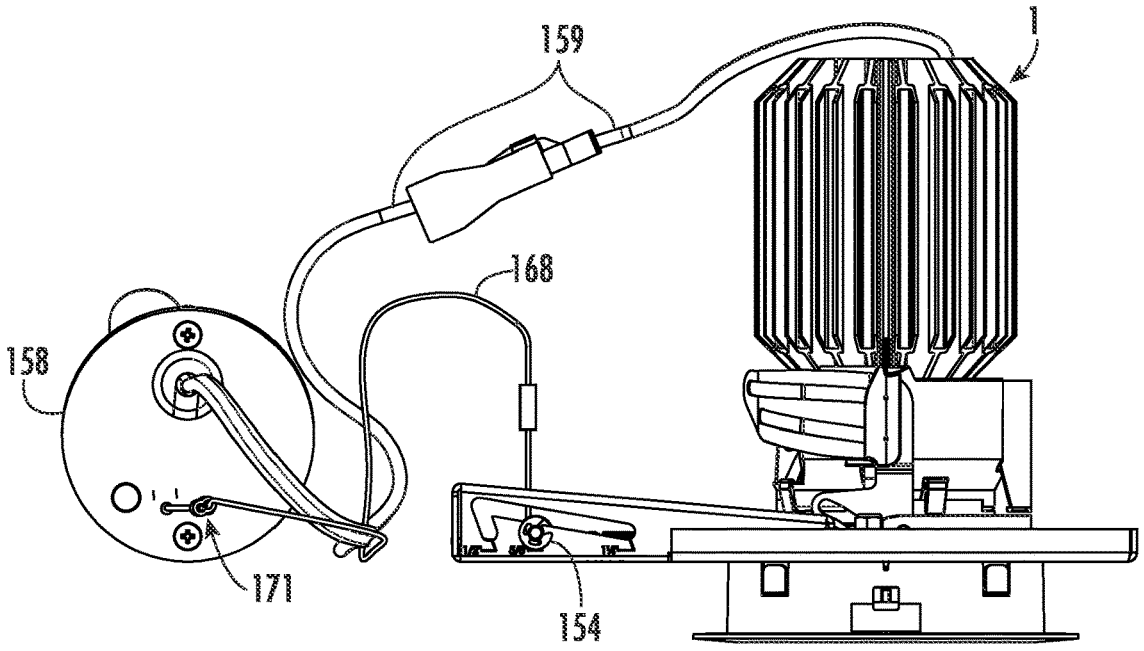
Figure 17:
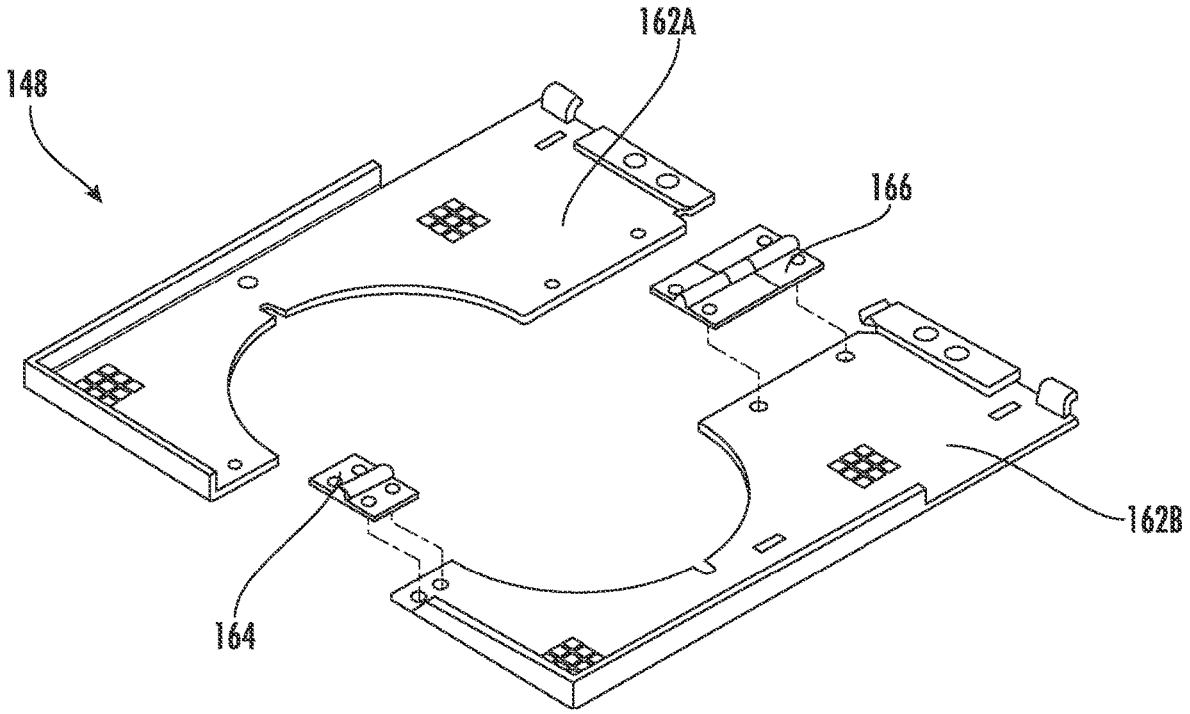
FIG. 17 is an exploded view of a foldable plate portion of the frame subassembly of FIG. 16A-B.
Figure 18A:
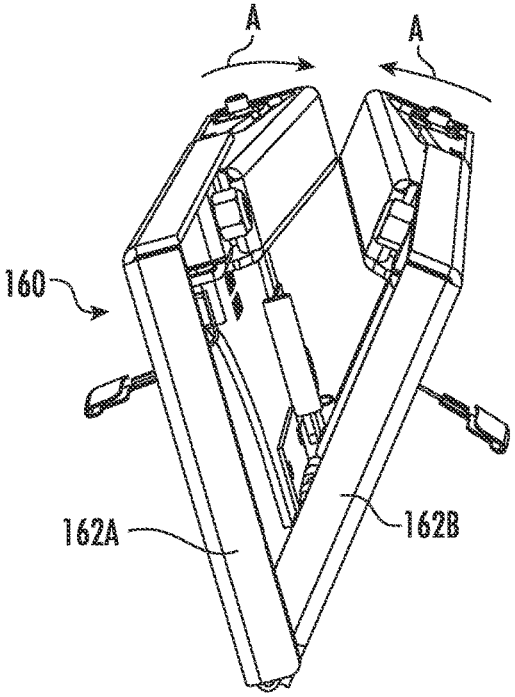
FIG. 18A-19C are various isometric views of the foldable plate portion of FIG. 17 being folded and inserted through an opening in a ceiling.
Figure 18B:
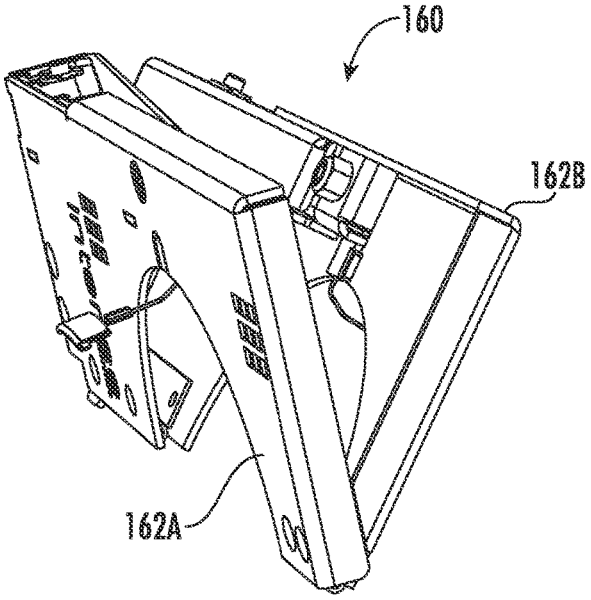
Figure 19A:
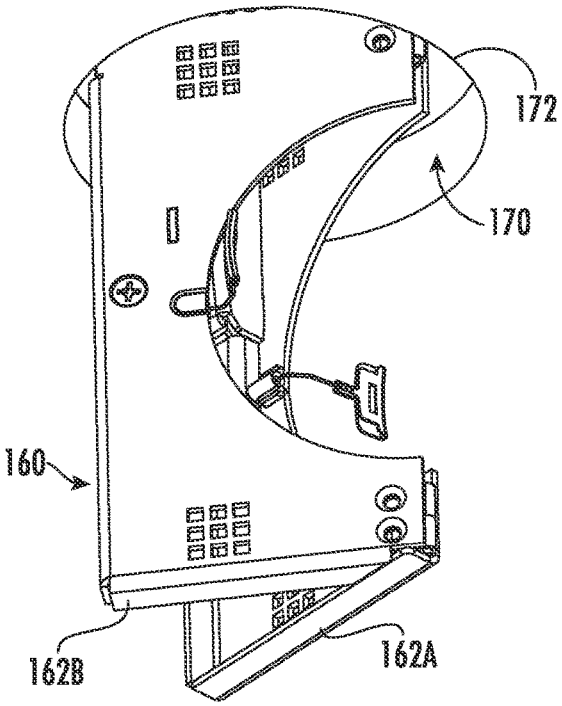
Figure 19B:
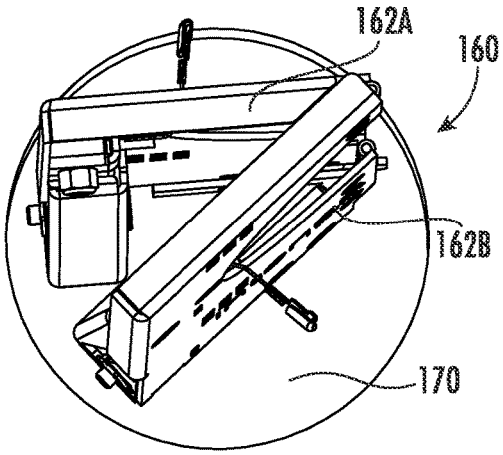
Figure 19C:
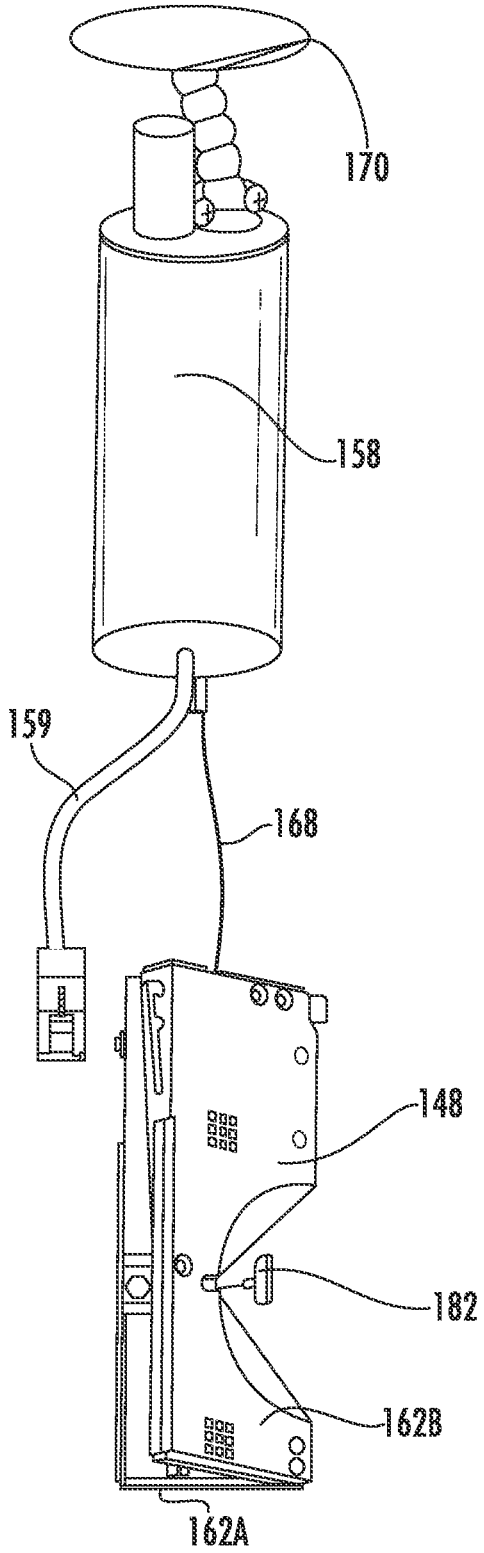

Referring now to FIGS. 15-17, the adjustable lighting assembly 1 is shown installed in conjunction with example embodiments of frame subassemblies 146, 148. FIG. 15 illustrates a version of a frame subassembly 146 that can be used for new construction applications, while FIGS. 16A-B and 17 illustrate a version of a frame subassembly 148 that can be used for remodel applications.

FIG. 15 shows a non-limiting example of an embodiment of the frame subassembly 146 including a plate portion 150 for engaging structure 151 associated with a ceiling. The plate portion 150 has an opening 152 for engaging the circular coupling portion 118 of the round collar flange assembly 114 or the square collar flange assembly 116 (see FIGS. 12A, 12B). As will be appreciated, the user can select between the round or square collar flange assembly 114, 116 depending on the shape of the opening in the ceiling. As previously described, the round or square collar flange assembly 114, 116 is engageable with the collar spring mount 26 and a module mount retainer ring 28 of the adjustable lighting assembly 1.

In one embodiment, in connection with one feature of the present disclosure, first and second height adjustment assemblies 154, 156 are positioned on the plate portion 150 on opposite sides of the opening 152. As will be described in greater detail later, the first and second height adjustment assemblies 154, 156 are couplable to the circular coupling portion 118 of the round or square collar flange assembly 114, 116 (depending on which one is installed) to apply an upward tension to the collar to ensure tight engagement with the ceiling.

As shown, a J-box assembly 158 is mounted adjacent an end of the plate portion 150. The J-box assembly 158 may contain electronics for conditioning line power and for transmitting the conditioned power, via wiring 159, to the LED chip 8 of the adjustable lighting assembly 1.

As mentioned, FIGS. 16A-B and 17 illustrates a non-limiting example of an embodiment of a frame subassembly 148 that can be used for remodel applications. The frame subassembly 148 has a plate portion 160 that is generally smaller than the plate portion 150 of the new construction frame subassembly 146. This is because in remodel applications the frame subassembly 148 is often installed through a relatively small existing opening in the ceiling.

The frame subassembly 148 may include a number of the same features as those of frame subassembly 146 of FIG. 15, including an opening 152 for engaging the circular coupling portion 118 of the round collar flange assembly 114 or the square collar flange assembly 116, and first and second height adjustment assemblies 154, 156 positioned on opposite sides of the opening 152. Thus, discussion of those features will not be repeated.

As will be appreciate, a remodel J-box assembly 158 may be coupled to the plate portion 160 via a flexible cable assembly 168. The flexible cable assembly 168 may be coupled at one end 169 to the plate portion 160 and at an opposite end 171 to the J-box assembly 158. Although a cable assembly is shown for coupling the J-box assembly 158 to the plate portion 160, other connection arrangements can also be used, including clips or the like. The J-box assembly 158 may contain electronics for conditioning line power and for transmitting the conditioned power, via wiring 159, to the LED chip 8 of the adjustable lighting assembly 1.

Referring now to FIGS. 17-19C, the plate portion 160 of the remodel frame assembly 148 may include first and second plate portions 162A, 162B connected by first and second hinges 164, 166. Thus arranged, the first and second plate portions 162A, 162B can be rotated toward each other about the first and second hinges 164, 166 (i.e., in the direction of arrows "A" in FIG. 18A) to reduce the overall size of the plate portion 160, enabling it to be inserted through a relatively small opening 170 in the ceiling 172 (see FIGS. 19A-C). In accordance with one feature of the present disclosure, the first and second hinges 164, 166 are biased towards the opened position (e.g., using appropriate spring elements) so that, once the folded plate portion 160 has passed through the opening 170 formed in the ceiling and is properly positioned, the installer can release the first and second plate portions 162A, 162B causing the first and second plate portions 162A, 162B to pop or rotate in the reverse direction about the first and second hinges 164, 166 to return the plate portion 160 to its original size.

As will be appreciated, the adjustable lighting assembly 1 may be installed in ceilings have a variety of ceiling thicknesses. For example, drywall/sheetrock ceiling typically have thicknesses of ½-inch or ⅝-inch, while double-layered drywall/sheetrock ceiling can have thicknesses of 1¼-inch. Regardless of the ceiling thickness, the adjustable lighting assembly 1 and any associated trim distance is consistent in order to maintain uniform illumination.

Figure 20:
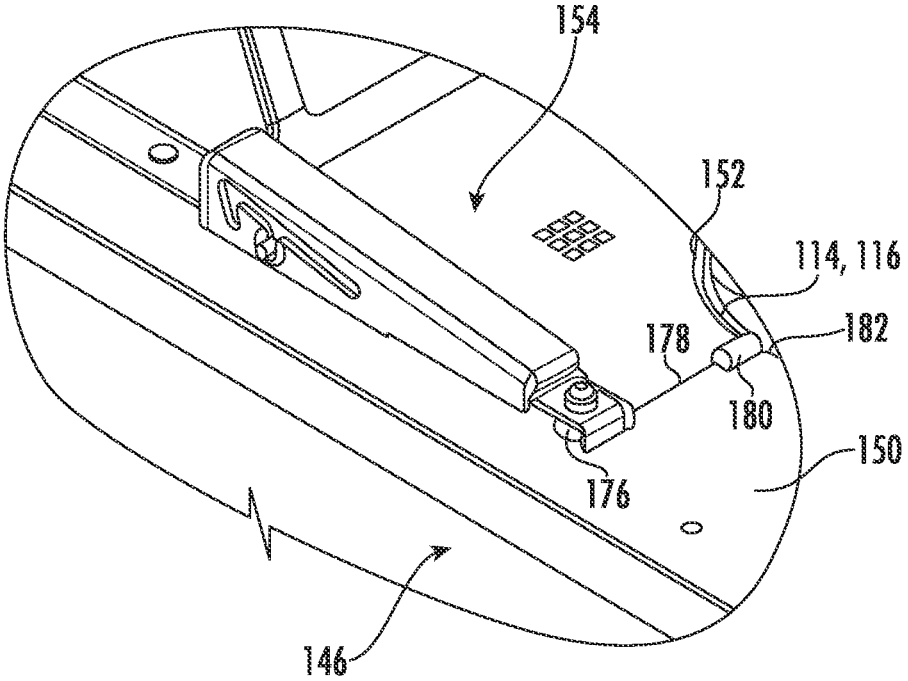
FIG. 20 is a partial isometric view of height adjustment assembly for use with the frame subassembly of FIGS. 15 and 16A-B.
Figure 21:
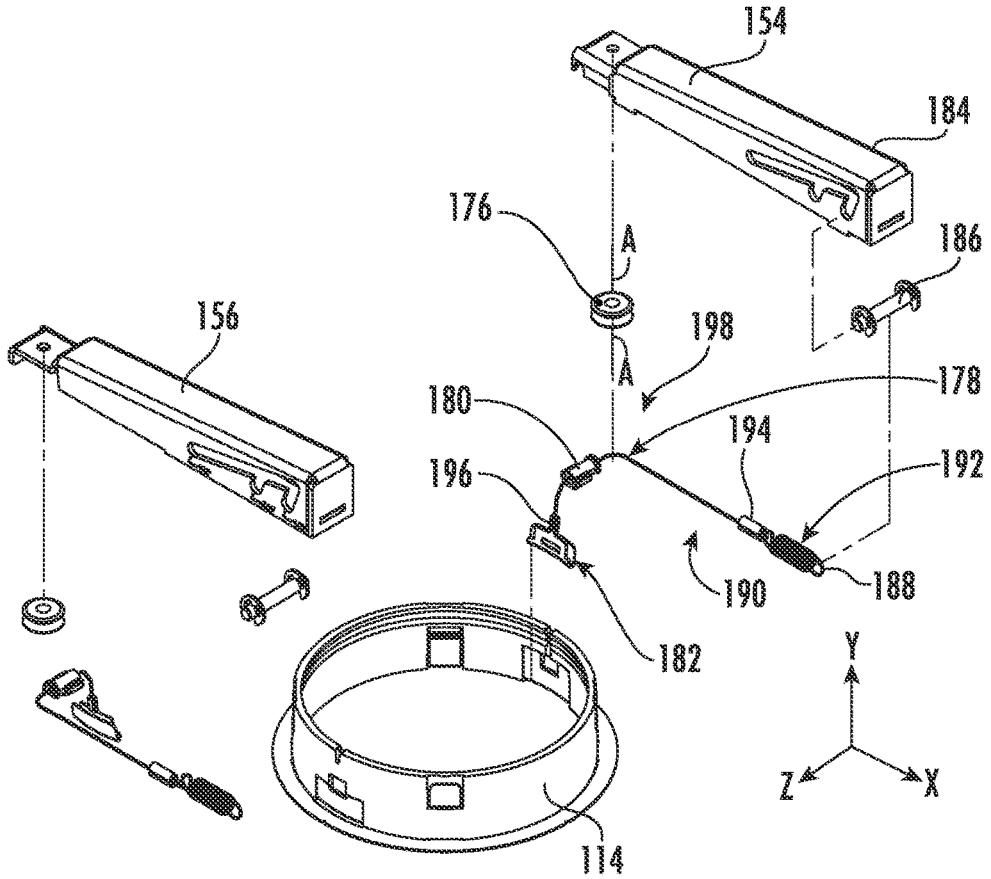
FIG. 21 is an exploded view of a pair of height adjustment assemblies for use with the frame subassembly of FIGS. 15 and 16A-B.

Referring to FIGS. 20-21, in accordance with another feature of the present disclosure, the first and second height adjustment assemblies 154, 156 may be used to provide a constant vertical tension to the round or square collar flange assembly 114, 116 (depending on which one is installed) to ensure that the round or square flange portion 114A, 116A of the round or square collar flange assembly maintains contact with the room-side surface of the associated ceiling, regardless of ceiling thickness.

Since the first and second height adjustment assemblies 154, 156 are mirror images of one another, the description will proceed with respect to the first height adjustment assembly 154. It will be appreciated, however, that the same description will apply to the second height adjustment assembly 156.

In general, the first height adjustment assembly 154 is a spring-loaded cable mounting system that applies a constant vertical tension to the round or square collar flange assembly 114, 116 that pulls the round or square collar flange assembly 114, 116 (depending on which one is being used) upward into engagement with the room-side surface of the associated ceiling. The first height adjustment assembly 154 is a low-profile arrangement which provides maximum clearance for the adjustable lighting assembly 1, regardless of rotational position or tilt angle.

As previously described, the first height adjustment assembly 154 is positionable on the plate portion 150 of the frame subassembly 146 or frame subassembly 148 adjacent to the opening 152 that receives the adjustable lighting assembly 1. The first height adjustment assembly 154 may include a spring assembly channel cover 184 couplable to the frame subassembly 146, 148. The first height adjustment assembly 154 also includes a pulley 176, a cable 178, a wire guide 180, and a collar attachment spring clip 182 for coupling to the round or square collar flange assembly 114, 116.

The first height adjustment assembly 154 may also a spring tension retainer 186 selectively positionable within the spring assembly channel cover 184. In use, the spring tension retainer 186 is coupled to a first end 188 of a spring wire assembly 190. The spring wire assembly 190 can include the cable 178, a compression spring 192 coupled to a first end 194 of the cable 178, the wire guide 180 for coupling the adjustable lighting assembly 1 to the frame subassembly 146, 148, and the collar attachment spring clip 182 for coupling to a second end 196 of the cable engaging the round or square collar flange assembly 114, 116.

The spring assembly channel cover 184 may, at one end thereof, accommodate the pulley 176, which in one non-exclusive example embodiment is a roller bushing v-notch pulley. The pulley 176 may be oriented so that its rotational axis A-A is parallel with the vertical axis "y". As can be seen, the compression spring 192 and first end 194 of the cable 178 are oriented substantially along the "x"-axis. The pulley 176 may engage a central portion 198 of the cable 178 to re-orient the cable to be oriented substantially parallel to the "z"-axis so that it is receivable through the wire guide 180 which is also oriented substantially parallel to the "z"-axis. Between the wire guide 180 and the collar attachment spring clip 182, the cable 178 is reoriented such that the second end 196 of the cable 178 is substantially parallel to the "y"-axis. Thus arranged, the cable 178 converts the horizontal ("x"-axis) tension force of the compression spring 192 to a vertical ("y"-axis) tension force that is applied to the round collar flange assembly 114, urging the adjustable lighting assembly 1 upward into engagement with the ceiling. Thus arranged, the first height adjustment assembly 154 biases the collar flange assembly adjacent to the room-side surface of the ceiling while minimizing the overall height of the height adjustment assemblies.

Figure 22:
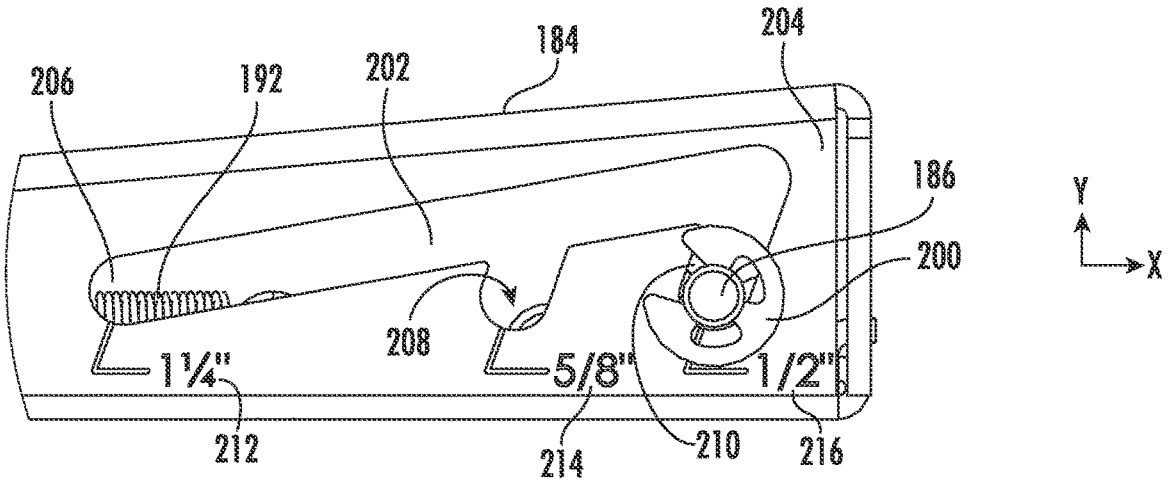
FIG. 22 is a partial side view of a spring assembly channel cover of the height adjustment assembly of FIG. 21.

FIG. 22 shows a portion of the spring assembly channel cover 184, spring tension retainer 186 and compression spring 192 installed therein. The spring tension retainer 186 is held within the spring assembly channel cover 184 using, for example, a clip 200. As can be seen, a groove 202 is disposed on a side-surface 204 of the spring channel assembly cover 184. The spring tension retainer 186 is selectively movable within the groove 202 so that a consistent tension is applied to the round collar flange assembly 114 regardless of ceiling thickness.

For example, the spring tension retainer 186 may be positioned in a first tensioning position, associated with a first end 206 of the groove 202, when the associated round collar flange assembly 118 is installed in a ceiling having a first thickness (e.g., 1-¼-inches). The spring tension retainer 186 may be positioned in a second tensioning position, associated with a first notch 208 disposed in the groove 202, when the associated round collar flange assembly 114 is installed in a ceiling having a second thickness (e.g., ⅝-inch) that is thinner than the first thickness. The spring tension retainer 186 may also be positioned in a third tensioning position, associated with a second notch 210 disposed in the groove 202, when the associated round collar flange assembly 118 is installed in a ceiling having a third thickness (e.g., ½-inch) that is thinner than the first and second thicknesses. As can be seen, a plurality of indicia 212, 214, 216 are marked on the side-surface 204 of the spring channel assembly cover 184, associated with the discrete positioning options for the spring tension retainer 186 (e.g., first end 206 of groove 202, first notch 208, second notch 210). The indicia enables a user to easily select a position for the spring tension retainer 186 based on the ceiling thickness encountered in a particular installation.

Figure 23B:
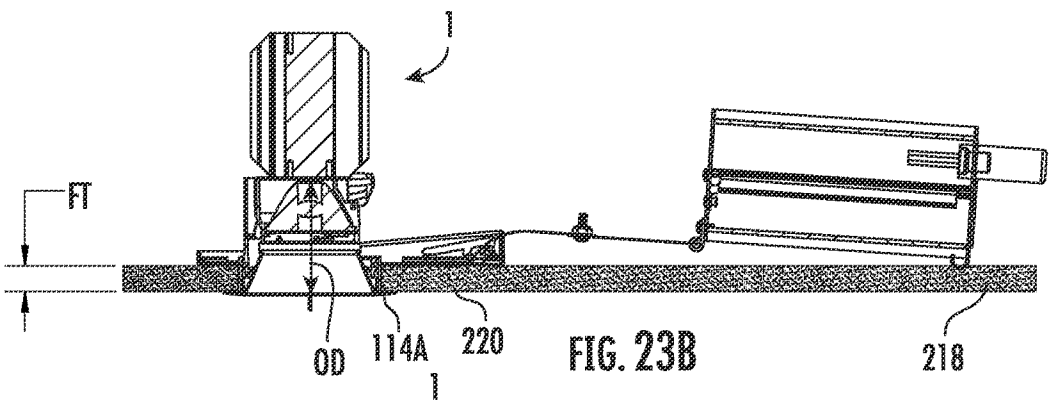
FIGS. 23A-25B are a series of side and cross-section views of the adjustable lighting assembly of FIG. 1, the height adjustment assembly of FIG. 20, and the frame subassembly of FIG. 16A-B mounted to ceiling of different thicknesses.
Figure 23A:
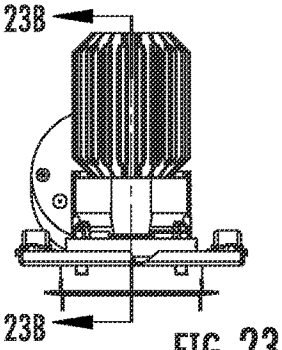

FIGS. 23A-25B show the adjustable lighting assembly 1 installed in ceilings having three different exemplary ceiling thicknesses. For example, FIGS. 23A-23B show the adjustable lighting assembly 1, frame subassembly 148 and first height adjustment assembly 154 installed in a ceiling 218 having a first thickness "FT", which in one non-limiting example embodiment is ½-inch. As can be seen, the spring tension retainer 186 is in the second notch 210 of the groove 202 in the spring channel assembly cover 184, and the flange portion 114A of the round collar flange assembly 114 is flush with the bottom surface 220 of the ceiling 218.

Figure 24B:
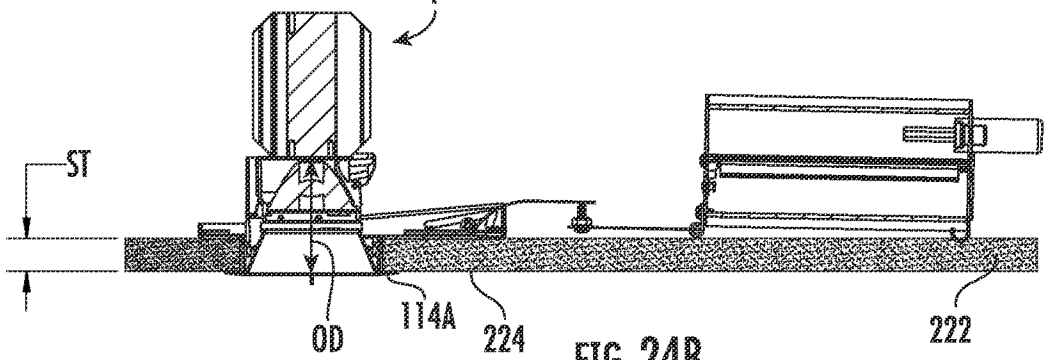
Figure 24A:
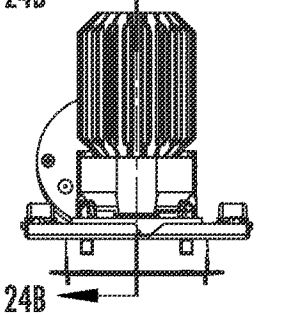

FIGS. 24A-B show the adjustable lighting assembly 1, frame subassembly 148, and first height adjustment assembly 154 installed in a ceiling 222 having a second thickness "ST" that is greater than the first thickness "FT". In one non-limiting example embodiment the second thickness "ST" is ⅝-inch. As can be seen, the spring tension retainer 186 is in the first notch 208 of the groove 202 in the spring channel assembly cover 184, and the flange portion 114A of the round collar flange assembly 114 is flush with the bottom surface 224 of the ceiling 222.

Figure 25B:
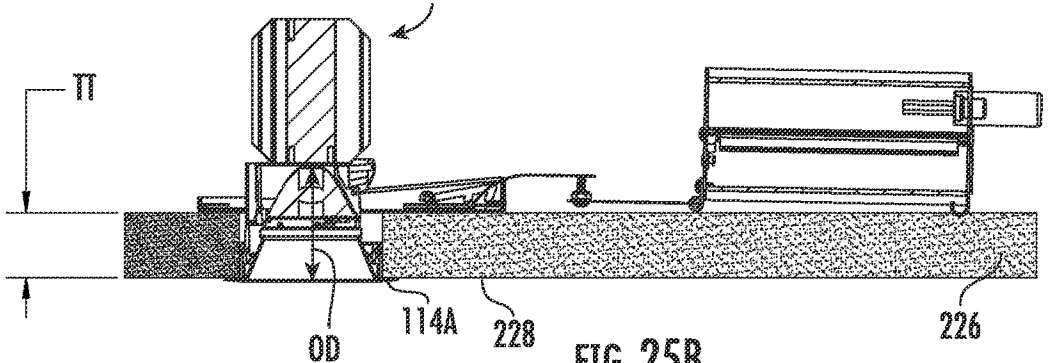
Figure 25A:
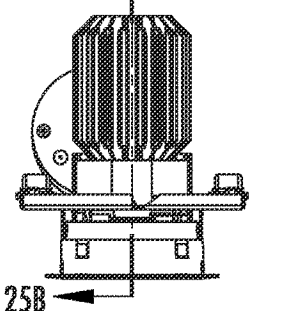

FIGS. 25A-B show the adjustable lighting assembly 1, frame subassembly 148, and first height adjustment assembly 154 installed in a ceiling 226 having a third thickness "TT" that is greater than the first and second thicknesses "FT", "ST". In one non-limiting example embodiment the third thickness "TT" is 1¼-inch. As can be seen, the spring tension retainer 186 is in the first end 206 of the groove 202 in the spring channel assembly cover 184, and the flange portion 114A of the round collar flange assembly 114 is flush with the bottom surface 228 of the ceiling 226.

As can be seen, the optic offset distance "OD" (i.e., the distance between the LED chip 8 and the bottom surface of the ceiling 220, 224, 228 remains constant regardless of the thickness (FT, ST, TT) of the ceiling 218, 222, 226 in which the adjustable lighting assembly 1 is installed. Thus, the amount and quality of light emitted by the adjustable lighting assembly 1 to the room will be substantially the same regardless of the ceiling thickness.

Figure 26:
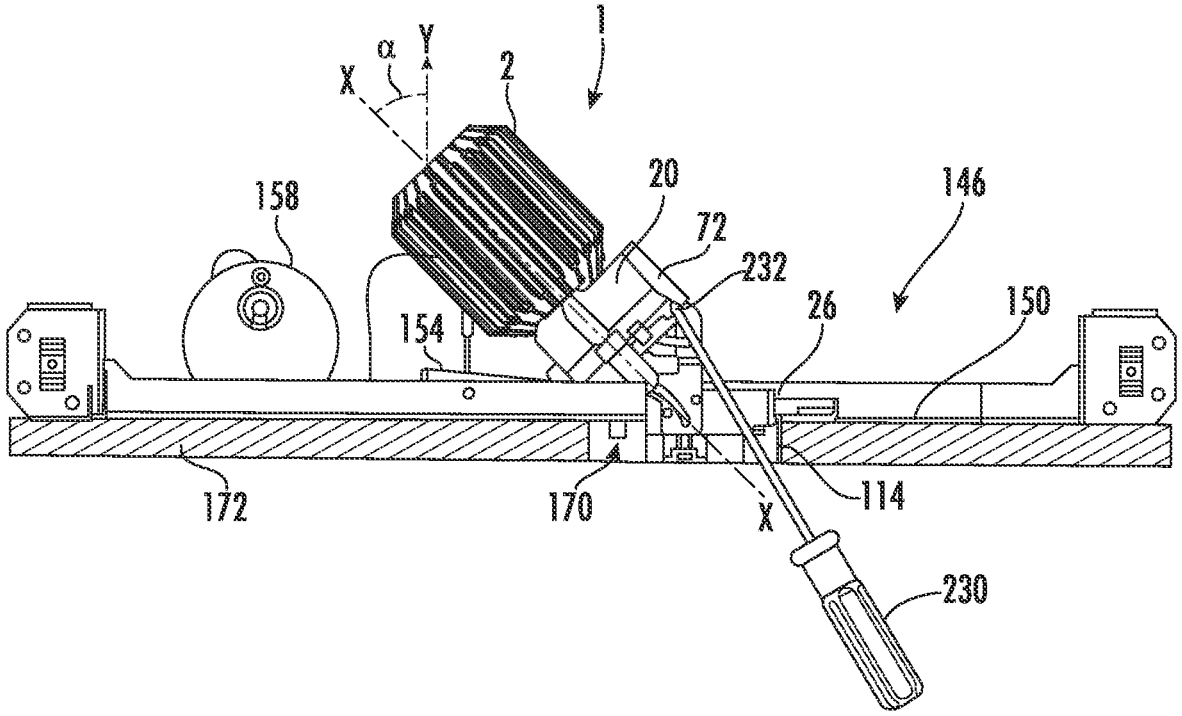
FIG. 26 is a side view of the example adjustable lighting assembly of FIG. 1 installed above a ceiling, illustrating an example positioning of a tool for adjustment thereof.

FIG. 26 shows the adjustable lighting assembly 1 coupled to the plate portion 150 of frame subassembly 146. The round collar flange assembly 114 is engaged in the opening 170 in the ceiling 172 and is coupled to the adjustable lighting assembly 1 via the collar spring mount 26. A tool 230, which in the non-limiting example embodiment is a screwdriver, is insertable through the opening 170 and the round collar flange assembly so that a tool end 232 of the tool is engageable with the integral tilt adjustment feature 72 of the optic holder pivot core 20. Thus engaged, the tool 230 can be used to tilt the adjustable lighting assembly 1 so that the central axis X-X of the adjustable lighting assembly 1 forms an oblique tilt angle "α" with respect to the vertical "y" axis. In some non-limiting embodiments, the tilt angle "α" is between 0-degrees and 45-degrees.

Figure 27:
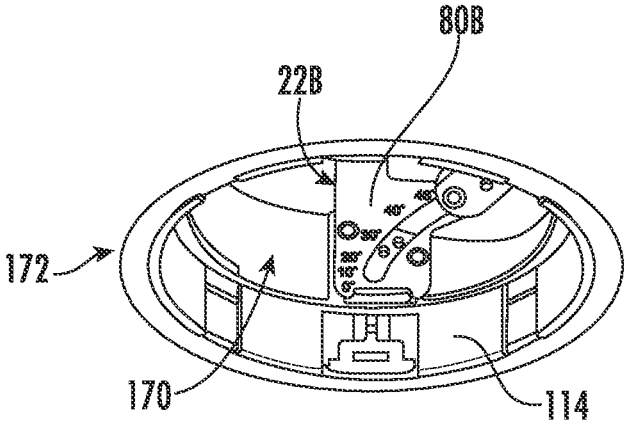
FIG. 27 is an isometric view of a portion of the example adjustable lighting assembly of FIG. 1 viewable from below a ceiling, illustrating the accessibility of the pivot spring guide bracket portion.
Figure 28:
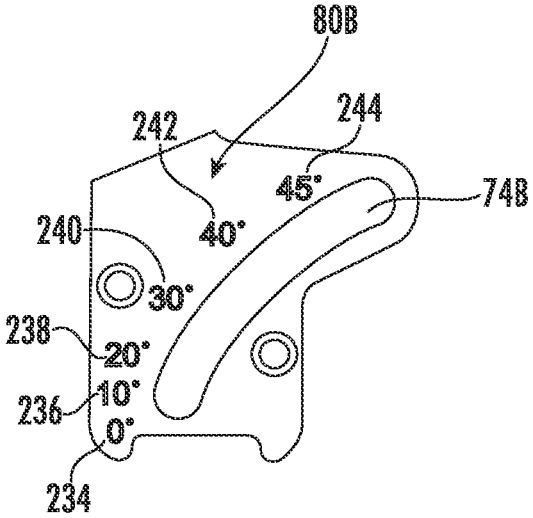
FIG. 28 is a side view of a portion of the pivot spring guide bracket portion illustrating discrete angular adjustment markings thereon.

FIGS. 27 and 28 illustrate a portion of the adjustable lighting assembly 1 that is viewable from below the ceiling, after the adjustable lighting assembly 1 has been installed in the opening 170 in the ceiling 172. An interior portion of the round collar flange assembly 114 is visible, as is the lower portion 80B of the pivot spring guide bracket 22B. Additionally, in one embodiment, a plurality of indicia 234-244 disposed adjacent to the first guide slot 74B in the lower portion 80B may be visible. (Similar indicia may optionally be provided adjacent first guide slot 74A in lower portion 80A.)

Thus arranged, the tilt angle "α" can be adjusted from below the ceiling 172 by extending the tool end 232 through the opening 170 so that it engages the tilt adjustment feature 72. By applying an upward force to the tilt adjustment feature 72 via the tool end 232, a rotational force is applied to the optic holder pivot core 20 that causes the optic holder pivot core 20 to tilt with respect to the round collar flange assembly 114 and the ceiling 172. Tilting of the optic holder pivot core 20 is guided by the fasteners disposed in opening 44 sliding in respective first guide slots 74A, 74B, and by the first and second projections 86A, 86B; 88A, 88B sliding in the second and third guide slots 76A, 76B; 78A, 78B as previously described.

The indicia 234-244 can be employed to allow the user to adjust the adjustable lighting assembly 1 to one of a variety of predetermined tilt angles "α" associated with the indicia. In one non-limiting example embodiment, the indicia 234-244 are associated with tilt angles "α" of 0-degrees, 10-degrees, 20-degrees, 30-degrees, 40-degrees and 45-degrees, respectively). By aligning the fastener disposed in the first guide slot 74B with a particular indicia, a desired tilt angle "α" of the adjustable lighting assembly 1 can be easily achieved without the need for measurement tools. Thus arranged, the user can easily adjust multiple lighting assemblies 1 to the same angle.

Figure 29:
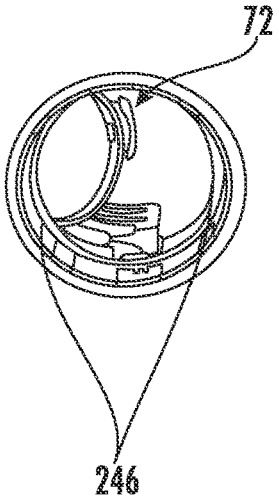
FIGS. 29-31 are various isometric views of a portion of the example adjustable lighting assembly of FIG. 1 viewable from below a ceiling, illustrating the position of a tool-receiving element for adjusting a tilt angle, and rotational position, of the adjustable lighting assembly, from below the ceiling.

FIG. 29 illustrates a position of the tilt adjustment feature 72 as viewed from below the ceiling 172, through the opening 170. Initially, an installer can access the tilt adjustment feature 72 to adjust the tilt angle "α" of the adjustable lighting assembly 1 without the need for a tool. Rotational adjustment (i.e., rotation about the "y"-axis (FIG. 26) can also be performed by hand in a similar manner, simply by applying rotational force to the tilt adjustment feature 72 and/or a pair of rotational tabs 246 which are diametrically opposed on interior surface of the adjustable lighting assembly 1. As can be seen best in FIG. 10, the rotational tabs 246 extend from 26 towards an occupied side of the ceiling opening. The rotational tabs 246 assist a user in rotating the adjustable lighting assembly 1 after installation by simply applying pressure against the tabs with the use of thumb and index finger.

Figure 30:
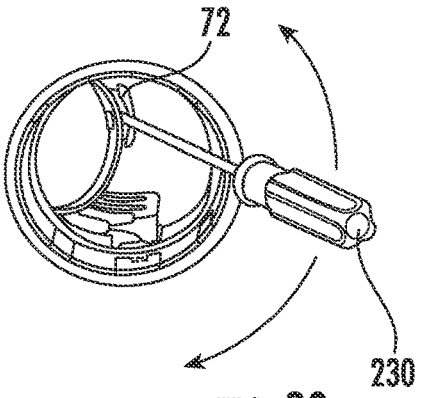
Figure 31:
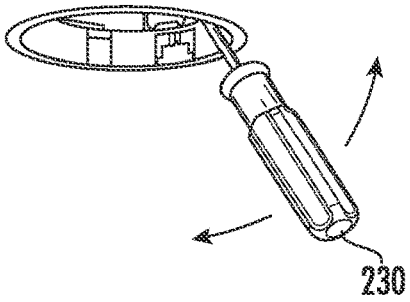

FIG. 30 illustrates a position of the tilt adjustment feature 72, again from below the ceiling 172 and through the opening 170, in which a tool 230 is used to make rotational adjustments (i.e., rotation about the "y"-axis (FIG. 26)). As will be appreciated, a tool 230 may be used when portions of the adjustable lighting assembly 1 are hot (i.e., as light is being projected through the opening 170). Tilt angle "α" adjustment can also be performed with the assembly "hot" using the tool 230 as shown in FIG. 31.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof

What is claimed is:

1. A pivot core arranged and configured for use in a lighting assembly, the lighting assembly including a heat sink, a light source coupled to the heat sink, and an adjustment module portion coupled to the heat sink and the pivot core, the pivot core comprising:

a primary optic for directing light from the light source through the adjustment module, the pivot core configured to hold and position the primary optic at a desired distance from the light source;

wherein the primary optic is arranged and configured to couple to the pivot core via a snap-in mechanism;

wherein the pivot core includes a lip and the primary optic includes a shoulder arranged and configured to receive the lip to position a rear end of the primary optic at a predetermined axial distance from the light source; and wherein the pivot core includes a first set of tabs positioned at spaced apart locations around a circumference of the pivot core, the first set of tabs arranged and configured to engage a front surface of the primary optic to capture the primary optic between the lip and an engagement surface on the first set of tabs when the primary optic is pressed past the first set of tabs and into engagement with the lip.

2. The pivot core of claim 1, wherein the pivot core includes one of an opening, a seam, or a slot formed in a wall thereof to enable the pivot core to flex upon application of a force to allow the primary optic to be received therein.

3. The pivot core of claim 1, wherein the pivot core includes a living hinge to allow the primary optic to be received therein.

4. The pivot core of claim 1, further comprising a secondary optic coupled to the pivot core, the secondary optic positioned directly adjacent to the primary optic.

5. The pivot core of claim 4, wherein the primary optic comprises one of a reflector, a diffusion lens, and a Fresnel lens.

6. The pivot core of claim 4, wherein the secondary optic is a film-based lens.

7. The pivot core of claim 4, wherein the secondary optic is arranged and configured to be changed independently of the primary optic.

8. The pivot core of claim 4, further comprising an accessory holder coupled to the pivot core, the accessory holder coupling the secondary optic to the pivot core.

9. The pivot core of claim 1, wherein the pivot core includes a second set of tabs arranged and configured to engage corresponding surfaces on a secondary optic to removably couple the secondary optic to the pivot core.

10. The pivot core of claim 9, further comprising an accessory holder including axially extending tabs, wherein the pivot core further comprises a plurality of circumferentially-spaced recesses formed in an outer surface thereof, the plurality of recesses being arranged and configured to receive the axially-extending tabs of the accessory holder to removably couple the accessory holder to the pivot core.

11. The pivot core of claim 1, wherein the pivot core is constructed of a unitary piece of plastic.

12. A pivot core arranged and configured for use in a lighting assembly, the lighting assembly including a heat sink, a light source coupled to the heat sink, and an adjustment module portion coupled to the heat sink and the pivot core, the pivot core comprising:

a primary optic for directing light from the light source through the adjustment module, the pivot core configured to hold and position the primary optic at a desired distance from the light source;

a secondary optic positioned directly adjacent to the primary optic; and an accessory holder coupled to the pivot core, the accessory holder coupling the secondary optic to the pivot core;

wherein the pivot core includes one of an opening, a seam, or a slot formed in a wall thereof to enable the pivot core to flex outward upon application of a force to allow the primary optic to be received therein; and wherein the pivot core includes a first set of tabs positioned at spaced apart locations around a circumference of the pivot core, the first set of tabs arranged and configured to engage a front surface of the primary optic to capture the primary optic between a lip formed in the pivot core and an engagement surface on the first set of tabs when the primary optic is pressed past the first set of tabs and into engagement with the lip.

13. The pivot core of claim 12, wherein the primary optic comprises one of a reflector, a diffusion lens, and a Fresnel lens.

14. The pivot core of claim 13, wherein the secondary optic is a film-based lens.

15. The pivot core of claim 12, wherein the secondary optic is arranged and configured to be changed independently of the primary optic.

16. The pivot core of claim 12, wherein the primary optic includes a shoulder arranged and configured to receive the lip to position a rear end of the primary optic at a predetermined axial distance from the light source.

17. The pivot core of claim 12, wherein the pivot core includes a second set of tabs arranged and configured to engage corresponding surfaces on a secondary optic to removably couple the secondary optic to the pivot core.

18. The pivot core of claim 17, wherein the accessory holder includes axially extending tabs, wherein the pivot core further comprises a plurality of circumferentially-spaced recesses formed in an outer surface thereof, the plurality of recesses being arranged and configured to receive the axially-extending tabs of the accessory holder to removably couple the accessory holder to the pivot core.

19. The pivot core of claim 12, wherein the pivot core is constructed of a unitary piece of plastic.

* * * * *